US007867407B2

(12) United States Patent
Kitahara

(10) Patent No.: US 7,867,407 B2
(45) Date of Patent: Jan. 11, 2011

(54) METHOD OF MANUFACTURING AN INK-JET RECORDING HEAD

(75) Inventor: Tsuyoshi Kitahara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 615 days.

(21) Appl. No.: 11/935,355

(22) Filed: Nov. 5, 2007

(65) Prior Publication Data

US 2008/0078740 A1 Apr. 3, 2008

Related U.S. Application Data

(62) Division of application No. 10/786,331, filed on Feb. 26, 2004, now Pat. No. 7,305,764, which is a division of application No. 09/708,514, filed on Nov. 9, 2000, now abandoned.

(30) Foreign Application Priority Data

| | | |
|---|---|---|
| Nov. 11, 1999 | (JP) | 11-321328 |
| Nov. 18, 1999 | (JP) | 11-328458 |
| Jan. 27, 2000 | (JP) | 2000-019135 |
| Sep. 25, 2000 | (JP) | 2000-290507 |

(51) Int. Cl.
*B41J 2/045* (2006.01)

(52) U.S. Cl. ..... 216/27; 216/41; 216/83; 216/58; 29/890.1; 347/54; 347/58; 347/69; 347/70; 347/71

(58) Field of Classification Search ..... 216/27, 216/41, 58, 83; 29/890.1; 347/54, 58, 69–72
See application file for complete search history.

(56) References Cited

U.S. PATENT DOCUMENTS

| | | | |
|---|---|---|---|
| 5,621,524 | A | 4/1997 | Mitani |
| 5,684,520 | A | 11/1997 | Morikoshi et al. |
| 5,754,205 | A | 5/1998 | Miyata et al. |
| 5,802,686 | A | 9/1998 | Shimada et al. |
| 5,933,170 | A | 8/1999 | Takeuchi et al. |
| 5,956,829 | A | 9/1999 | Kitahara et al. |
| 6,158,847 | A | 12/2000 | Usui et al. |
| 6,305,792 | B1 | 10/2001 | Otsuka et al. |

FOREIGN PATENT DOCUMENTS

| | | |
|---|---|---|
| DE | 198 59 498 | 8/1999 |
| EP | 0 616 890 | 9/1994 |
| EP | 0 761 447 | 3/1997 |
| EP | 0 786 346 | 7/1997 |

(Continued)

*Primary Examiner*—Shamim Ahmed
(74) *Attorney, Agent, or Firm*—Sughrue Mion, PLLC

(57) ABSTRACT

An ink-jet recording head has a plate-shaped member including a first layer with a partition wall formed by a first etching process and defining a pressure chamber, an ink inlet passage and a common ink storage chamber, a second layer with a land formed by a second etching process so as to correspond to the pressure chamber, and an intermediate layer sandwiched between the first and the second layers. The recording head also has a pressure producing device disposed with its extremity in contact with the land, and a nozzle plate with a nozzle hole bonded to the front surface of the plate-shaped member. An ink particle is jetted through the nozzle hole when the pressure in the pressure chamber is changed by the pressure producing device.

3 Claims, 22 Drawing Sheets

FOREIGN PATENT DOCUMENTS

| | | | |
|---|---|---|---|
| EP | 0 787 589 | | 8/1997 |
| EP | 0 829 355 | | 3/1998 |
| EP | 0 916 500 | | 5/1999 |
| EP | 1 024 001 | | 8/2000 |
| EP | 1 038 676 | | 9/2000 |
| JP | 05-116326 | | 5/1993 |
| JP | 06-023982 | | 2/1994 |
| JP | 06-021937 | | 3/1994 |
| JP | 06-087217 | | 3/1994 |
| JP | 06-305142 | | 11/1994 |
| JP | 07-096605 | * | 4/1995 |
| JP | 07-178906 A | | 7/1995 |
| JP | 08-187868 | | 7/1996 |
| JP | 09-039242 | | 2/1997 |
| JP | 09-123448 | | 5/1997 |
| JP | 09-300635 | | 11/1997 |
| JP | 09-314863 | | 12/1997 |

* cited by examiner

METHOD OF MANUFACTURING AN INK-JET RECORDING HEAD

CROSS-REFERENCE TO RELATED APPLICATIONS

This is a divisional of application Ser. No. 10/786,331 filed Feb. 26, 2004 U.S Pat No. 7,305,764. Application Ser. No. 10/786,331 is a divisional of application Ser. No. 09/708,514, filed Nov. 9, 2000 now abandoned. Priority is claimed from JP 2000-290507 filed Sep. 25, 2000, from JP 2000-19135 filed Jan. 27, 2000, from JP 1999-328458 filed Nov. 18, 1999, and also from JP 1999-321328 filed Nov. 11, 1999. The entire disclosures of the prior applications, application Ser. No. 10/786,331 and 09/708,514, and the above-identified priority documents, are hereby incorporated by reference.

BACKGROUND OF THE INVENTION

1. Field of the Invention

The present invention relates to an ink-jet recording head and a method of manufacturing the same. More particularly, the present invention relates to an ink-jet recording head that jets ink particles through nozzle holes by changing the pressure of pressure chambers by deformations of pressure producing devices and a method of manufacturing such an ink-jet recording head.

2. Description of the Related Art

Generally, the ink-jet recording apparatus has a recording head provided with a plurality of nozzle holes arranged in a row, a scanning mechanism for moving a carriage supporting the recording head thereon in a scanning direction parallel to the width of a recording medium, such as a recording sheet, and a sheet feed mechanism for feeding a recording sheet in a feed direction parallel to the length of the recording sheet.

The recording head has a head structure provided with pressure chambers and nozzle holes respectively communicated with the pressure chambers, and pressure producing devices for changing the pressure of the ink contained in the pressure chambers. Ink particles are jetted through each nozzle hole by applying a driving pulse to the pressure producing device to change the pressure of the ink contained in the pressure chamber.

The scanning mechanism moves the carriage supporting the recording head in the scanning direction for a recording operation. During the recording operation, the recording head jets ink particles at points of time specified by dot pattern data. Upon the arrival of the recording head at the terminal point of a scanning range, the scanning mechanism returns the recording head to a starting point of the scanning range and the sheet feed mechanism moves the recording medium in the feed direction. Then, the scanning mechanism starts moving the carriage in the scanning direction and the recording head jets ink particles while the same is moved in the scanning direction. The recording head may be driven for printing during only a forward travel or may be driven for printing during both a forward travel and a return travel. These operations are repeated according to dot pattern data to record an image on the recording sheet.

Some ink-jet recording apparatus applies selectively a plurality of kinds of driving pulse of different waveforms produced from a common driving signal of a predetermined waveform to a recording head to jet ink particles of different kinds, such as ink particles respectively having different particle sizes. The period of the common driving signal, i.e., driving period, determines the printing speed of the recording apparatus.

FIG. 30 is an enlarged fragmentary sectional view of a recording head included in an ink-jet recording apparatus and FIG. 31 is an enlarged sectional view of pressure chambers and portions around the pressure chambers of the recording head shown in FIG. 30. As shown in FIGS. 30 and 31, a recording head 50 has a flexible sheet 53, a plate-shaped member 52 having partition walls 51 and attached to the front surface of the flexible sheet 53, and a plate-shaped member 55 having a plurality of lands 54 and attached to the back surface of the flexible sheet 53.

The partition walls 51 define a plurality of pressure chambers 56, a plurality of ink inlet passages 57 and common ink storage chambers 58. The pressure chambers 56 communicate with the common ink storage chambers 58 by means of the ink inlet passages 57, respectively. The lands 54 correspond to the pressure chambers 56, respectively.

The extremities of pressure producing devices 59 are in contact with the lands 54, respectively. The pressure producing device 59 includes a piezoelectric vibrator of a longitudinal vibration mode having a laminated piezoelectric element. The pressure producing devices 59 are attached to a fixed plate 60 fixed to a case 61.

Portions of the flexible sheet 53 around the lands 54 serve as elastic, deformable parts 63 capable of being elastically deformed by a deformation of the pressure producing devices 59.

A nozzle plate 64 is bonded to the front surface of the plate-shaped member 52. The nozzle plate 64 is provided with a plurality of nozzle holes 65 respectively connected to the pressure chambers 56.

The plurality of nozzle holes 65 are arranged along the feed direction on the recording head 50 at intervals corresponding to predetermined pitches that defines a dot density.

The extremity of an ink supply pipe 66 extended through the case 61, the plate-shaped member 55 and the flexible sheet 53 is connected to the common ink storage chamber 58 to supply the ink into the common ink storage chamber 58.

When manufacturing the known ink-jet recording head shown in FIGS. 30 and 31, a flat plate for forming the plate-shaped member 55 is attached to the back surface of the flexible sheet 53, and the lands 54 of the flat plate are formed on the flexible sheet 53 by etching the flat plate.

On the other hand, the plate-shaped member 52 provided with the partition walls 51 is bonded to the front surface of the flexible sheet 53 with an adhesive. Therefore, as shown in FIG. 32, it sometimes occurs that part 67 of the adhesive spreads into the pressure chamber 56 and the ink inlet port 57.

If the part 67 of the adhesive spreads into the pressure chamber 56 and the ink inlet port 57, pressure applied to the flexible sheet 53 cannot be satisfactorily transmitted to the pressure chamber 56 due to the deterioration of the flexibility of the flexible sheet 53 by the detrimental effect of the adhesive on the flexible sheet 53. Portions of the flexible sheet 53 corresponding to the different pressure chambers 56 have different deforming properties, respectively. As a result, the nozzle holes 65 have different ink jetting characteristics, respectively.

When bonding the plate-shaped member 52 provided with the partition walls 51 to the flexible sheet 53, it is difficult to bond the plate-shaped member 52 to the flexible sheet 53 so that the pressure chambers 56 are formed accurately in correct positional relation to the lands 54. Consequently, pressure cannot be properly applied to the pressure chambers. Portions of the flexible sheet 53 corresponding to the plurality of pressure chambers 56 are deformed differently. As a result, the nozzle holes 65 have different ink jetting characteristics, respectively.

When manufacturing the known recording head, portions of the plate-shaped member 52 having the partition walls 51 are removed by etching to form grooves for forming the ink inlet passages 57 before bonding the plate-shaped member 52 to the flexible sheet 53. If the portions of the plate-shaped member 52 are etched unequally and the grooves are formed different depths, respectively, the ink inlet passages 57 have different sectional areas, respectively. Consequently, pressure cannot be satisfactorily transmitted to the pressure chambers 56. The portions of the flexible sheet 53 respectively corresponding the plurality of pressure chambers 56 are deformed differently. As a result, the nozzle openings have different ink jetting characteristics, respectively.

Generally, as shown in FIGS. 33 and 34, an ink-jet recording head (hereinafter, referred to simply as "recording head") employing pressure producing devices each including a piezoelectric vibrator of a longitudinal vibration mode has a passage unit 301 provided with a plurality of nozzle holes 308 and a plurality of pressure chambers 307, and a case 302 containing piezoelectric vibrators 306. The passage unit 301 is attached to the case 302.

The passage unit 301 is formed by superposing a nozzle plate 303 provided with the nozzle holes 303 arranged in rows, a passage plate 304 provided with a plurality of pressure chambers 307 respectively connected to the nozzle holes 308, and a vibrating plate 305 attached to the lower surface of the passage plate 304 so as to cover the lower open ends of the pressure chambers 307. The passage plate 304 is provided with ink storage chambers 309 connected to the pressure chambers 307 by ink inlet passages 310.

The case 302 is formed of a synthetic resin and has spaces 312 extending between the upper and the lower surface thereof. The piezoelectric vibrators 306 are contained in the spaces 312. The piezoelectric vibrators 306 have back ends fixed to base plates 311 attached to the case 302 and front ends fixed to lands 305A formed on the lower surface of the vibrating plate 305.

A driving signal produced by a 314 is transmitted through a flexible wiring plate 313 to the corresponding piezoelectric vibrator 306 to vibrate the piezoelectric vibrator longitudinally. Consequently, the land 305A of the vibrating plate 305 is vibrated to change the pressure in the pressure chamber 307, and thereby the ink contained in the pressure chamber 307 is jetted in ink particles through the nozzle holes 308. In FIG. 33, indicated as 315 are ink supply ports through which the ink is supplied to the ink storage chambers 309.

The passage plate 304 of the passage unit 301 is a plate formed by subjecting a single-crystal silicon substrate to an anisotropic etching process, such as that disclosed in JP-A No. Hei 9-123448, or an electroformed plate formed on a pattern by an electroforming process and removed from the pattern, such as those disclosed in JP-A No. Hei 6-305142 or Hei 9-300635.

When processing a single-crystal silicon substrate by an anisotropic etching process to form the passage plate 304 provided with the pressure chambers 307 and the ink inlet passages 310, the depth of the ink inlet passage 310 is controlled by calculating the etching time necessary to etch the layer in a desired depth. It is difficult to achieve the accurate control of the depth of the ink inlet passages 310 by such a method and there is a limit to the improvement of the accuracy of the depth of the ink inlet passages 310. When the passage plate 304 is formed by processing a photosensitive resin plate, a partition wall between the adjacent pressure chambers 307 is liable to be deformed by pressure applied to one of the adjacent pressure chambers 307 and crosstalk between the adjacent pressure chambers 307 occurs if the pressure chambers 307 are arranged in a high density because the photosensitive resin, as compared with a metal or silicon, has a low rigidity and, therefore, it is impossible to arrange the nozzle holes 308 in a high density. When the passage plate 304 is an electroformed plate, the passage plate 304 has a low dimensional accuracy because the electroformed plate is liable to be warped when removing the same from the pattern and the dimensional accuracy of the electroformed plate is liable to be reduced. The electroformed plate needs an additional process for removing the electroformed plate from the pattern, which is one of factors of cost increases.

In the recording head, the pressure chambers 307, the ink storage chambers 309 and the ink inlet passages 310 are formed in the single passage plate 304. Therefore, the passage plate 304 must have an area sufficient for arranging the pressure chambers 307, the ink storage chambers 309 and the ink inlet passages 310 thereon, and the miniaturization of the recording head is limited by the passage plate 304. Since the recording head employs the piezoelectric vibrators 306 of the longitudinal vibration mode, the passage unit 301 is liable to be deformed by the vibrations of the piezoelectric vibrators 306 and crosstalk is liable to occur. Therefore, the rigidity of the passage unit 301 must be increased to the highest possible extent, which places a restriction on the miniaturization of the recording head.

The passage plate 304 of the conventional recording head is a plate formed by subjecting a single-crystal silicon substrate to an anisotropic etching process, a plate formed by processing a photosensitive resin plate or an electroformed plate. The depth of the passages of the passage plate 304 formed by subjecting a single-crystal silicon substrate to an anisotropic etching process is controlled by calculating the etching time. Therefore it is difficult to form the passages accurately in a desired depth, which is a restriction on accuracy improvement. When the passage plate 304 is formed by processing a photosensitive resin plate, the partition wall between the adjacent pressure chambers 307 is liable to be deformed and crosstalk between the adjacent pressure chambers 307 occurs if the pressure chambers 307 are arranged in a high density because the photosensitive resin has a low rigidity and, therefore, it is impossible to arrange the nozzle holes 308 in a high density. When the passage plate 304 is an electroformed plate, the passage plate 304 has a low dimensional accuracy because the electroformed plate is liable to be warped when removing the same from the pattern and the dimensional accuracy of the electroformed plate is liable to be reduced. The electroformed plates needs an additional process for removing the electroformed plate from the pattern, which is one of factors of cost increases.

SUMMARY OF THE INVENTION

The present invention has been made in view of the foregoing problems and it is therefore an object of the present invention to provide an ink-jet recording head having a very small unevenness in ink jetting characteristics of nozzle holes, and a method of manufacturing such an ink-jet recording head.

Another object of the present invention is to provide an ink-jet recording head advantageous for accuracy improvement and dot density increase, and to provide a method of manufacturing such an ink-jet recording head.

A third object of the present invention to provide an ink-jet recording head capable of being formed in very small dimensions and advantageous to increasing the level of integration.

According to the present invention, an ink-jet recording head comprises: a pressure producing device for changing a pressure in a pressure chamber containing an ink; a plate-shaped member having a front surface and a back surface, the plate-shaped member having a partition wall formed on the front surface by a first etching process, the partition wall defining the pressure chamber, an ink inlet passage and a common ink storage chamber, the plate-shaped member having a land formed on the back surface by a second etching process so as to correspond to the pressure chamber and be in contact with an extremity of the pressure producing device, the plate-shaped member having an elastic and deformable portion which is formed by the first etching process and the second etching process so as to surround the land, the elastic and deformable portion being capable of being elastically deformed by a deformation of the pressure producing device; and a nozzle plate provided with a nozzle hole through which an ink particle is jetted when the pressure in the pressure chamber is changed by the deformation of the pressure producing device, the nozzle plate being disposed on a side of the front surface of the plate-shaped member.

Preferably, the plate-shaped member includes a first layer having the front surface, a second layer having the back surface and an intermediate layer sandwiched between the first layer and the second layer, the first etching process etches a desired portion of the first layer selectively over the intermediate layer so that the first layer is penetrated, and the second etching process etches a desired portion of the second layer selectively over the intermediate layer so that the second layer is penetrated.

Preferably, the plate-shaped member includes a first layer having the front surface, a second layer having the back surface, an intermediate layer sandwiched between the first layer and the second layer, a first adhesive layer bonding the first layer and the intermediate layer together and a second adhesive layer bonding the second layer and the intermediate layer together, the first etching process etches a desired portion of the first layer selectively over the first adhesive layer so that the first layer is penetrated, and the second etching process etches a desired portion of the second layer selectively over the second adhesive layer so that the second layer is penetrated.

Preferably, the first and the second layers are formed of a stainless steel, and the intermediate layer is formed of a polymer film.

Preferably, the plate-shaped member is formed of a single sheet which is made of a single material, the first etching process etches a desired portion of the front surface of the plate-shaped member in a depth equal to part of a thickness of the plate-shaped member, and the second etching process etches a desired portion of the back surface of the plate-shaped member in a depth equal to part of the thickness of the plate-shaped member.

Preferably, the plate-shaped member is made of a stainless steel.

According to the present invention, an ink-jet recording head comprises: a pressure producing device for changing a pressure in a pressure chamber containing an ink; a plate-shaped member having a front surface, a back surface, the plate-shaped member having a partition wall formed on the front surface, the partition wall defining the pressure chamber, an ink inlet passage and a common ink storage chamber, the plate-shaped member having a land formed on the back surface so as to correspond to the pressure chamber and be in contact with an extremity of the pressure producing device, the plate-shaped member having an elastic and deformable portion surrounding the land and being capable of being elastically deformed by a deformation of the pressure producing device, the plate-shaped member including a first layer having the front surface, a second layer-having the back surface, and an intermediate layer sandwiched between the first and the second layers, and not having any adhesive layer or the like between the first and the intermediate layers nor between the second and the intermediate layers; and a nozzle plate provided with a nozzle hole through which an ink particle is jetted when the pressure in the pressure chamber is changed by a deformation of the pressure producing device, the nozzle plate being disposed on a side of the front surface of the plate-shaped member.

Preferably, the partition wall is formed by etching a desired portion of the first layer selectively over the intermediate layer by a first etching process so that the first layer is penetrated, and the land is formed by etching a desired portion of the second layer selectively over the intermediate layer by a second etching process so that the second layer is penetrated.

Preferably, the plate-shaped member is formed of a single sheet which is made of a single material, the partition wall is formed by etching a desired portion of the plate-shaped member from the front surface by a first etching process in a depth equal to part of a thickness of the plate-shaped member, and the land is formed by etching a desired portion of the plate-shaped member from the back surface by a second etching process in a depth equal to part of the thickness of the plate-shaped member.

Preferably, the plate-shaped member is made of a stainless steel.

Preferably, the ink-jet recording head further comprises a base member sandwiched between the plate-shaped member and the nozzle plate, the base member having an auxiliary ink storage chamber communicated with the common ink storage chamber.

Preferably, the auxiliary ink storage chamber is offset from a position corresponding to the common ink storage chamber and partly overlaps the ink inlet passage.

Preferably, the ink-jet recording head further comprises a base member sandwiched between the plate-shaped member and the nozzle plate, wherein the plate-shaped member and the nozzle plate are bonded to the base member with polyolefin adhesive films.

Preferably, an adhesive receiving groove is formed in the front surface of the plate-shaped member corresponding to the partition wall to suppress a protrusion of an adhesive when bonding the nozzle plate or the base member to the front surface of the plate-shaped member with the adhesive.

According to the present invention, an ink-jet recording head manufacturing method of manufacturing an ink-jet recording head comprising a pressure producing device for changing a pressure in a pressure chamber containing an ink; a plate-shaped member having a front surface and a back surface, the plate-shaped member having a partition wall formed on the front surface defining the pressure chamber, an ink inlet passage and a common ink storage chamber, the plate-shaped member having a land formed on the back surface so as to correspond to the pressure chamber and be in contact with an extremity of the pressure producing device, the plate-shaped member having an elastic and deformable portion surrounding the land and being capable of being elastically deformed by a deformation of the pressure producing device; and a nozzle plate provided with a nozzle hole through which an ink particle is jetted when the pressure in the pressure chambers is changed by the deformation of the pressure producing device, the nozzle plate being disposed on a side of the front surface of the plate-shaped member; the ink-jet recording head manufacturing method comprises: a first etching step for etching the plate-shaped member to form the partition wall on the front surface of the plate-shaped member; a second etching step for etching the plate-shaped member to form the land on the back surface of the plate-shaped member; and a nozzle plate attaching step for attaching the nozzle plate directly to or via another member to the front surface of the plate-shaped member.

Preferably, the plate-shaped member includes a first layer having the front surface, a second layer having the back surface and an intermediate layer sandwiched between the first and the second layers, the first etching step etches a desired portion of the first layer selectively over the intermediate layer so that the first layer is penetrated, and the second etching step etches a desired portion of the second layer selectively over the intermediate layer so that the second layer is penetrated.

Preferably, the plate-shaped member includes a first layer having the front surface, a second layer having the back surface, an intermediate layer sandwiched between the first and the second layers, a first adhesive layer bonding the first layer and the intermediate layer together and a second adhesive layer bonding the second layer and the intermediate layer together, the first etching step etches a desired portion of the first layer selectively over the first adhesive layer so that the first layer is penetrated, and the second etching step etches a desired portion of the second layer selectively over the second adhesive layer so that the second layer is penetrated.

Preferably, the plate-shaped member is formed of a single sheet which is made of a single material, the first etching step etches a desired portion of the front surface of the plate-shaped member in a depth equal to part of a thickness of the plate-shaped member, and the second etching step etches a desired portion of the back surface of the plate-shaped member in a depth equal to part of the thickness of the plate-shaped member.

Preferably, the ink-jet recording head manufacturing method further comprises a step of disposing a base member having an auxiliary ink storage chamber communicated with the common ink storage chamber between the plate-shaped member and the nozzle plate.

Preferably, the auxiliary ink storage chamber is disposed so that the auxiliary ink storage chamber is offset from a position corresponding to the common ink storage chamber and partly overlaps the ink inlet passage.

Preferably, the ink-jet recording head manufacturing method further comprises steps of disposing a base member between the plate-shaped member and the nozzle plate, and bonding the plate-shaped member and the nozzle plate to the base member with polyolefin adhesive films.

Preferably, an adhesive receiving groove is formed in the front surface of the plate-shaped member corresponding to the partition wall to suppress a protrusion of the adhesive when bonding the nozzle plate or the base member to the front surface of the plate-shaped member with the adhesive.

According to the present invention, an ink-jet recording head comprises: a passage unit formed by superposing a nozzle plate having a nozzle hole, a passage plate provided with a passage including a pressure chamber communicated with the nozzle hole, and a vibrating plate covering an open end of the pressure chamber; and a pressure producing device for deforming the vibrating plate to change a pressure in the pressure chamber; wherein the passage plate has a front surface and a back surface, a connecting hole is formed in the front surface of the passage plate by a first etching process so as to be communicated with the nozzle hole, and the passage is formed in the back surface of the passage plate by a second etching process.

Preferably, the passage plate has a laminated structure including a first base plate having the front surface and provided with the connecting hole formed by the first etching process, a second base plate having the back surface and provided with the passage formed by the second etching process, and an etch terminating layer sandwiched between the first and the second base plates; the connecting hole is formed by etching a desired portion of the first base plate by the first etching process which is terminated by the etch terminating layer; and the passage is formed by etching a desired portion of the second base plate by the second etching process which is terminated by the etch terminating layer.

Preferably, the connecting hole formed in the first base plate serves also as the nozzle hole, and the first base plate serves also as the nozzle plate.

Preferably, the etch terminating layer is formed of an adhesive layer.

Preferably, the second base plate is made of a metal, and the etch terminating layer is made of a metal which is harder to be etched than the metal forming the second base plate.

Preferably, the metal forming the second base plate is a stainless steel or nickel, and the metal forming the etch terminating layer is titanium, silver or gold.

Preferably, the passage plate is formed of a single sheet which is made of a single material, the first etching process etches a desired portion of the front surface of the passage plate in a depth equal to part of a thickness of the passage plate, and the second etching process etches a desired portion of the back surface of the passage plate in a depth equal to part of the thickness of the passage plate.

Preferably, the passage plate is made of a stainless steel.

Preferably, the pressure producing device is a piezoelectric vibrator of a longitudinal vibration mode.

Preferably, the pressure producing device is a piezoelectric vibrator of a flexural vibration mode.

Preferably, the passage formed in the back surface of the passage plate by the second etching process is a space forming the pressure chamber, an ink inlet passage through which an ink is supplied into the pressure chamber, and an ink storage chamber for storing an ink to be supplied into the pressure chamber.

Preferably, an auxiliary ink storage chamber is formed in the front surface of the passage plate so as to be communicated with the ink storage chamber.

Preferably, the ink-jet recording head further comprises an additional passage plate having same construction as the passage plate and superposed on the passage plate.

Preferably, a metal layer is attached to the back surface of the passage plate, and the metal layer is provided with a passage similar to the passage.

According to the present invention, an ink-jet recording head manufacturing method of manufacturing an ink-jet recording head comprising: a passage unit formed by superposing a nozzle plate having a nozzle hole, a passage plate provided with a passage including a pressure chamber communicated with the nozzle hole, and a vibrating plate covering an open end of the pressure chamber, and a pressure producing device for deforming the vibrating plate to change a pressure in the pressure chamber, the ink-jet recording head manufacturing method comprises: a first etching step for etching a plate-shaped member having a front surface and a back surface to form a connecting hole in the front surface so as to be communicated with the nozzle hole; a second etching step for etching the plate-shaped member to form the passage including the pressure chamber in the back surface of the plate-shaped member; and an assembling step for assembling the passage unit by laminating the nozzle plate and the vibrating plate to the front and the back surfaces, respectively, of the passage plate which is the plate-shaped member processed by the first and the second etching processes.

Preferably, the plate-shaped member includes a first member having the front surface, a second member having the back surface and an etch terminating layer sandwiched between the first and the second members, the first and the second etching processes are terminated by the etch terminating layer.

Preferably, the passage plate is formed of a single sheet which is made of a single material, the first etching process etches a desired portion of the front surface of the passage plate in a depth equal to part of a thickness of the passage plate, and the second etching process etches a desired portion of the back surface of the passage plate in a depth equal to part of the thickness of the passage plate.

Preferably, the passage formed in the back surface of the passage plate by the second etching process is a space forming the pressure chamber, an ink inlet passage through which an ink is supplied into the pressure chamber, and an ink storage chamber for storing an ink to be supplied into the pressure chamber.

Preferably, an auxiliary ink storage chamber is formed in the front surface of the plate-shaped member so as to be communicated with the ink storage chamber when forming the connecting hole by the first etching process.

According to the present invention, an ink-jet recording head comprises: a passage unit including a nozzle plate having a nozzle hole, a passage plate provided with a pressure chamber communicated with the nozzle hole and an ink storage chamber for storing an ink to be supplied into the pressure chamber, and a vibrating plate covering an open end of the pressure chamber; and a piezoelectric vibrator of a longitudinal vibration mode for deforming the vibrating plate to change a pressure in the pressure chamber; wherein the passage plate includes a first base plate provided with the pressure chamber, a second base plate provided with a connecting hole connecting the pressure chamber to the nozzle hole and the ink storage chamber, and an ink inlet passage plate provided with an ink inlet passage connecting the pressure chamber to the ink storage chamber and sandwiched between the first and the second base plates, the ink storage chamber at least partly overlapping the pressure chamber; and the first base plate includes a first etching plate provided with the pressure chamber, a first etch terminating layer serving as the vibrating plate, and a second etching plate forming a land to be in contact with the piezoelectric vibrator on a surface of the vibrating plate; the pressure chamber being formed by etching a desired portion of the first etching plate to the first etch terminating layer, and the land is formed by etching a desired portion of the second etching plate to the second etch terminating layer.

Preferably, a damping chamber capable of absorbing a pressure variation in the ink storage chamber is formed in the second base plate on a side of the nozzle plate.

Preferably, the second base plate includes a third etching plate provided with the ink storage chamber, a fourth etching plate provided with the damping chamber, and a second etch terminating layer sandwiched between the third and the fourth etching plates, the ink storage chamber is formed by etching a desired portion of the third etching plate to the second etch terminating layer, and the damping chamber is formed by etching a desired portion of the fourth etching plate to the second etch terminating layer.

Preferably, the etch terminating layer is an adhesive layer.

Preferably, the etching plate is made of a metal, and the etch terminating layer is made of a metal harder to be etched than the meal forming the etching plate.

Preferably, the metal forming the etching plate is a stainless steel or nickel, and the metal forming the etch terminating layer is titanium, silver or gold.

Preferably, the etch terminating layer is a polymer film, and the etch terminating layer is laminated to the etching plate via an adhesive layer.

According to the present invention, an ink-jet recording head comprises: a passage unit including a nozzle plate having a nozzle hole, a passage plate provided with a pressure chamber communicated with the nozzle hole, an ink storage chamber for storing an ink to be supplied into the pressure chamber, and a vibrating plate covering an open end of the pressure chamber; and a pressure producing device for deforming the vibrating plate to change a pressure in the pressure chamber; wherein the passage plate includes a laminated structure formed by sandwiching an etch terminating layer between a pair of etching plates, at least either the pressure chamber or the ink storage chamber is formed by etching a desired portion of the etching plate to the etch terminating layer, and the etch terminating layer serves as at-least either a flexible plate defining a part of the ink storage chamber or the vibrating plate.

According to the present invention, an ink-jet recording head manufacturing method of manufacturing an ink-jet recording head comprising a passage unit including a nozzle plate having a nozzle hole, a passage plate provided with a pressure chamber communicated with the nozzle hole, an ink storage chamber for storing an ink to be supplied into the pressure chamber and a vibrating plate covering an open end of the pressure chamber, and a pressure producing device with a longitudinal vibrating mode for deforming the vibrating plate to change a pressure in the pressure chamber; the ink-jet recording head manufacturing method comprises the steps of: forming a laminated structure by sandwiching a first etch terminating layer between a first etching plate and a second etching plate; forming the pressure chamber by etching a desired portion of the first etching plate to the first etch terminating layer; forming a land by etching a desired portion of the second etching plate to the first etch terminating layer; and bonding a second base plate provided with a connecting hole for connecting the pressure chamber to the nozzle hole and the ink storage chamber to a first base plate having the laminated structure provided with the pressure chamber and the land so that the ink storage chamber at least partly overlap the pressure chamber.

Preferably, the ink-jet recording head manufacturing method further comprises the step of forming the second base plate which comprises the steps of: forming a laminated structure by sandwiching a second etch terminating layer between a third etching plate and a fourth etching plate; forming the ink storage chamber and the connecting hole by etching desired portions of the third etching plate to the second etch terminating layer; and forming a damping chamber by etching a desired portion of the fourth etching plate to the second etch terminating layer, the damping chamber being capable of absorbing a pressure variation in the ink storage chamber.

Preferably, the ink-jet recording head manufacturing method further comprises the step of sandwiching an ink inlet passage plate provided with an ink inlet passage connecting the ink storage chamber to the pressure chamber between the first and the second base plates.

Preferably, the nozzle plate, the second base plate, the ink inlet passage plate and the first base plate are bonded together by adhesive films, portions of the adhesive films corresponding to openings formed in the nozzle plate, the second base plate, the ink inlet passage plate and the first base plate, respectively, are removed before the adhesive films are attached to the nozzle plate, the second base plate, the ink inlet passage plate and the first base plate.

Since the partition wall is formed in the front surface of the plate-shaped member by the first etching process and the land is formed in the back surface of the plate-shaped member by the second etching process, any adhesive does not protrude into the pressure chamber and the ink inlet passage, the pressure chamber and the land are aligned with an improved accuracy and the difference in ink jetting characteristic between the nozzle openings can be reduced.

Preferably, the plate-shaped member is formed by sandwiching the intermediate layer between the first and the second layers. The first layer can be etched through selectively over the intermediate layer without etching the intermediate layer. Therefore, the sectional area of the ink inlet passage is dependent only on the thickness of the first layer. The difference in sectional area between the ink inlet passages can be reduced and thereby the difference in ink jetting characteristics between the nozzle holes can be reduced.

The ink-jet recording head of the present invention has the base plate provided in the front and the back surfaces thereof with the connecting hole and the passage formed by the first and the second etching processes. Therefore, the ink-jet recording head, as compared with the conventional ink-jet recording head provided with a passage plate coated with a photosensitive resin film, can be provided with rigid partition wall defining the pressure chamber and the pressure chambers can be arranged in a high density. Since the ink-jet recording head does not have any components formed by electroforming on patterns and removed from the patterns, the accuracy of the ink-jet recording head is not reduced and the ink-jet recording head is advantageous in cost. The pressure chamber and the connecting hole can be accurately aligned with each other.

Preferably, the passage plate is formed by laminating the first base plate, the etch terminating layer and the second base plate, the connecting hole and the passage are formed by etching portions of the first and the second base plates corresponding to the connecting hole and the passage to the etch terminating layer. Therefore, the depths of the connecting hole and the passage are dependent on the thicknesses of the first and the second base plates and are not dependent on the etching time. Consequently, the connecting hole and the passage are formed highly accurately in desired depths, respectively.

The ink-jet recording head manufacturing method of the present invention forms the connecting hole and the passage in the front and the back surfaces of the plate-shaped member by the first and the second etching processes. Therefore, the ink-jet recording head manufacturing method of the present invention, as compared with the conventional ink-jet recording head manufacturing method that laminates a photosensitive resin film to a passage plate, is able to form rigid partition wall defining the pressure chamber and to arrange the pressure chambers in a high density. Since the ink-jet recording head manufacturing method does not need any electroforming process that forms a member on a pattern and removes the member from the pattern, the accuracy of the ink-jet recording head is not reduced and the ink-jet recording head is advantageous in cost. The pressure chamber and the connecting hole can be accurately aligned with each other.

Preferably, the plate-shaped member is formed by laminating the first base plate, the etch terminating layer and the second base plate, and the connecting hole and the passage are formed by etching portions of the first and the second base plates corresponding to the connecting hole and the passage to the etch terminating layer. The depths of the connecting hole and the passage are dependent on the thicknesses of the first and the second base plates and not dependent on the etching time. Consequently, the connecting hole and the passage can be very accurately formed in desired depths, respectively.

In the ink-jet recording head of the present invention, the pressure chamber and the ink storage chamber are formed on different levels, respectively, so that the ink storage chamber overlaps the pressure chamber partly. Therefore, the passage unit can be formed in an area far smaller than that of the passage unit of the conventional ink-jet recording head, and hence the ink-jet recording head can be greatly miniaturized, which is advantageous to increasing the level of integration. Since the passage unit can be formed in a comparatively great thickness, the longitudinal rigidity of the piezoelectric vibrator of a longitudinal vibration mode can be greatly increased and crosstalk attributable to the deformation of the passage unit can be suppressed.

The ink-jet recording head manufacturing method of the present invention forms the pressure chamber and the land by etching the first etching plate and the second etching plate to the first etch terminating layer, respectively. Therefore, the depth of the pressure chamber and the thickness of the land are dependent on the respective thicknesses of the first and the second etching plates, respectively, and not dependent on the etching time. Consequently, the pressure chamber can be accurately formed in a desired depth and the land can be accurately formed in a desired thickness. Since the rigid partition wall defining the pressure chamber can be formed, the pressure chambers can be arranged in a high density. Since the ink-jet recording head manufacturing method does not need any electroforming process that forms a member on a pattern and removes the member from the pattern, the accuracy of the ink-jet recording head is not reduced and the ink-jet recording head is advantageous in cost.

Preferably, the ink storage chamber and the damping chamber are formed by etching the third and the fourth etching plates to the second etch terminating layer. Since the depths of the ink storage chamber and the damping chamber are dependent on the thicknesses of the third and the fourth etching plates and not dependent on the etching time, the ink storage chamber and the damping chamber can be highly accurately formed in desired depths. Since the ink-jet recording head manufacturing method does not need any process that removes a member from a pattern, the accuracy of the ink-jet recording head is not reduced and the ink-jet recording head is advantageous in cost.

BRIEF DESCRIPTION OF THE DRAWINGS

The above and other objects, features and advantages of the present invention will become more apparent form the following description taken in connection with the accompanying drawings, in which.

DETAILED DESCRIPTION OF THE INVENTION

Figure 1:
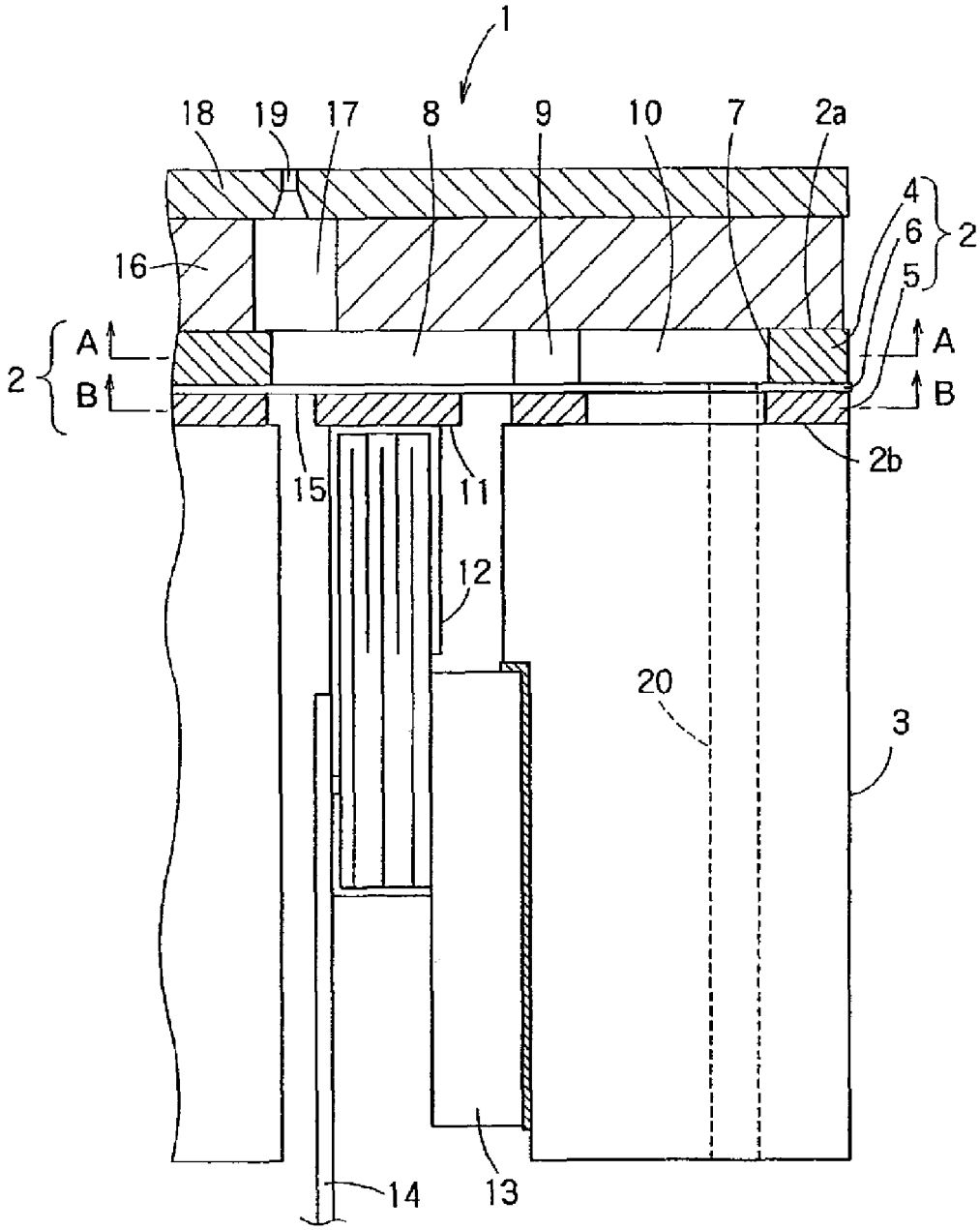
FIG. 1 is a sectional view of an essential portion of an ink-jet recording head in a first embodiment according to the present invention.

Referring to FIG. 1 showing an ink-jet recording head 1 in a first embodiment according to the present invention, a plate-shaped member 2 includes a first layer 4, a second layer 5 and an intermediate layer 6 sandwiched between the first layer 4 and the second layer 5. The first layer 4 has an outer surface as the front surface 2*a* of the plate-shaped member 2, the second layer 5 has an outer surface as the back surface 2*b* of the plate-shaped member 2, and the intermediate layer 6 is a flexible sheet. The plate-shaped member 2 is attached to a case 3 with the back surface 2*b* thereof in contact with the front surface of the case 3.

Figure 2:
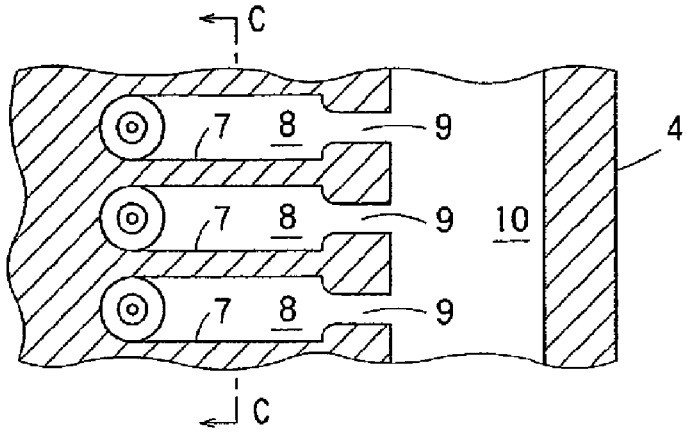
FIG. 2 is a sectional view taken on line A-A in FIG. 1.

As shown in FIGS. 1 and 2, partition walls 7 are formed in the first layer 4 by a first etching process on the side of the front surface 2*a* of the plate-shaped member 2. The partition walls 7 define a plurality of pressure chambers 8, a plurality of ink inlet passages 9 and a common ink storage chamber 10. The common ink storage chamber 10 communicates with the pressure chambers 8 by means of the ink inlet passages 9. The first etching process is, for example, a wet etching process.

Figure 3:
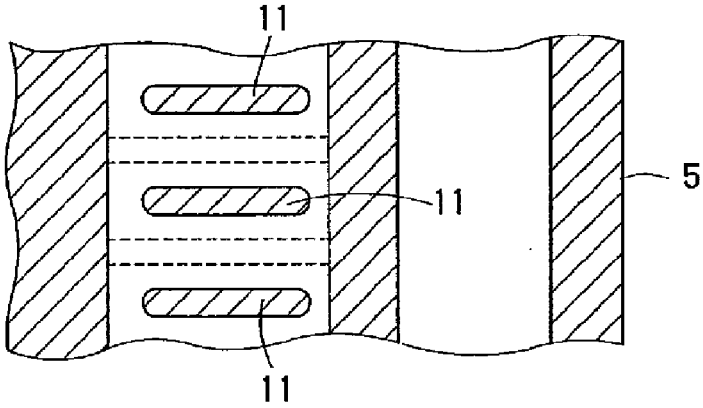
FIG. 3 is a sectional view taken on line B-B in FIG. 1.

As shown in FIGS. 1 and 3, a plurality of lands 11 are formed in the second layer 5 at positions respectively corresponding to the plurality of pressure chambers 8 by a second etching process on the side of the back surface 2*b* of the plate-shaped member 2. The second etching process is, for example, a wet etching process.

Figure 4:
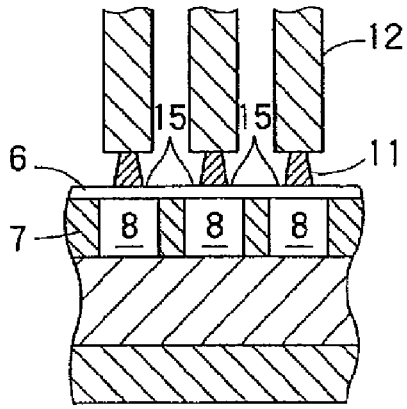
FIG. 4 is a sectional view taken on line C-C in FIG. 2.

As shown in FIGS. 1 and 4, a plurality of pressure producing devices 12 each including a piezoelectric vibrator of a longitudinal vibration mode having a laminated piezoelectric element are held in the case with their extremities attached respectively to the lands 11. As shown in FIG. 1, pressure producing devices 12 are held on a fixed plate 13 fastened to the case 3. A flexible cable 14 is connected to pressure producing devices 12.

As shown in FIGS. 1 and 4, portions of the intermediate layer 6 around the lands 11 are elastically deformable parts 15 capable of being deformed by deformations of the pressure producing devices 12.

As shown in FIG. 1, a base member 16 is attached to the front surface 2*a* of the plate-shaped member 2. The base member 16 is provided with connecting holes 17 respectively connected to the pressure chambers 8. A nozzle plate 18 is attached to the front surface of the base member 16. The nozzle plate 18 is provided with nozzle holes 19 respectively connected to the connecting holes 17. The nozzle holes 19 are arranged along several lines respectively parallel to the feed direction. The nozzle holes 19 are arranged in the feed direction at predetermined pitches corresponding to dot density.

An ink supply pipe 20 is extended through the case 3, the second layer 5 and the intermediate layer 6 and is connected to the common ink storage chamber 10 to supply the ink to the common ink storage chamber 10.

Each of the pressure producing devices 12 of the ink-jet recording head 1 has a characteristic to contract in a direction perpendicular to an electric field when charged and to extend in a direction perpendicular to an electric field when discharged. In this ink-jet recording head 1, the pressure producing device 12 contracts when charged to pull the land 11 backward so that the pressure chamber 8 is expanded, and extends when discharged to push the land 11 forward so that the pressure chamber 8 is compressed and the pressure contained in the pressure chamber 8 rises.

A common driving signal COM or a print data signal SI is applied through the flexible cable 14 to the pressure producing device 12 to jet an ink particle through the nozzle hole 19 by operating the pressure producing device 12 by a predetermined driving pulse.

Figure 5A:
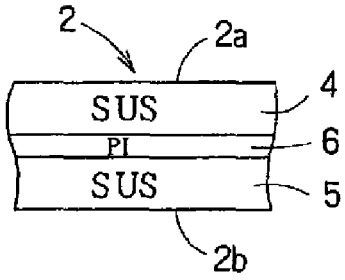
FIGS. 5A, 5B and 5C are fragmentary sectional views of different possible plate-shaped members, respectively.

A method of manufacturing the ink-jet recording head in the first embodiment will be described hereinafter. The plate-shaped member 2 is formed by sandwiching the intermediate layer 6 between the first layer 4 and the second layer 5. The plate-shaped member 2 may be any one of those shown in FIGS. 5A, 5B and 5C. The plate-shaped member 2 shown in FIG. 5A has an intermediate layer 6 formed of a polyimide resin (PI), and a first layer 4 and a second layer 5 formed of a stainless steel. The intermediate layer 6 may be formed of titanium. Various materials may be used in proper combinations for forming the first layer 4, the second layer and the intermediate layer 6. Essentially, a combination of materials is determined selectively so that the first layer 4 and the second layer 5 can be etched selectively over the intermediate layer 6.

Figure 5B:
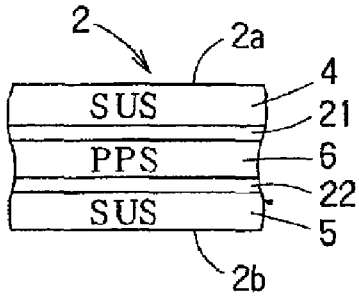

The plate-shaped member 2 shown in FIG. 5B has an intermediate layer 6 formed of a polymeric material, such as PPS, and a first layer 4 and a second layer 5 formed of a stainless steel. The first layer 4 and the intermediate layer 6 are bonded together by a first adhesive layer 21, and the second layer 5 and the intermediate layer are bonded together by a second adhesive layer 22.

Figure 5C:
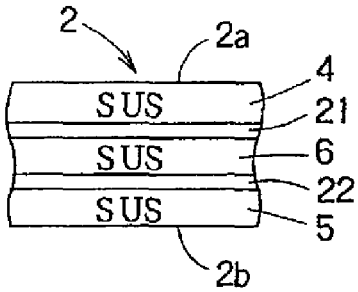

The plate-shaped member 2 shown in FIG. 5C has a first layer 4, a second layer 5 and an intermediate layer 6 formed of a stainless steel. The first layer 4 and the intermediate layer 6 are bonded together by a first adhesive layer 21, and the second layer 5 and the intermediate layer 6 are bonded together by a second adhesive layer 22.

The first etching process etches through the first layer 4 in a predetermined pattern from the side of the front surface 2*a* of the plate-shaped member 2 to form the partition walls 7 by the etched first layer 4. Parameters of the first etching process are determined so that the first layer 4 is etched selectively over the intermediate layer 6.

The second etching process etches through the second layer 5 in a predetermined pattern from the back surface 2*b* of the plate-shaped member 2 to form the plurality of lands 11 by the etched second layer 5. Parameters of the second etching process are determined so that the second layer 5 is etched selectively over the intermediate layer 6.

The base member 16 is bonded to the front surface 2*a* of the plate-shaped member 2, and the nozzle plate 18 is bonded to the outer surface of the base member 16 by a nozzle plate attaching process.

As mentioned above, the front surface 2*a* and the back surface 2*b* of the plate-shaped member 2 are subjected to the first and the second etching processes, respectively, to form the partition walls 7 in the side of the front surface 2*a* and to form the lands 11 in the side of the back surface 2*b*. Therefore, any adhesive does not protrude into the pressure chambers 8 and the ink inlet passages 9, the accuracy of the positional relation between the pressure chambers 8 and the lands 11 is improved and the difference in ink jetting characteristic between the nozzle holes 19 can be reduced.

The portions of the first layer 4 can be removed in the desired pattern by etching without etching the intermediate layer 6 by the first etching process that etches the first layer 4 selectively over the intermediate layer 6. Consequently, the sectional areas of the ink inlet passages 9 are dependent on the thickness of the first layer 4, the difference in sectional area between the ink inlet passages 9 is reduced and hence the difference in ink jetting characteristic between the nozzle holes 19 can be reduced.

Figure 6:
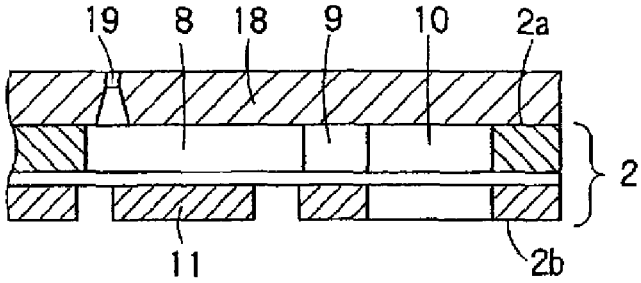
FIG. 6 is a fragmentary sectional view of a plate-shaped member and a nozzle plate employed in a first modification of the ink-jet recording head shown in FIG. 1.
Figure 7:
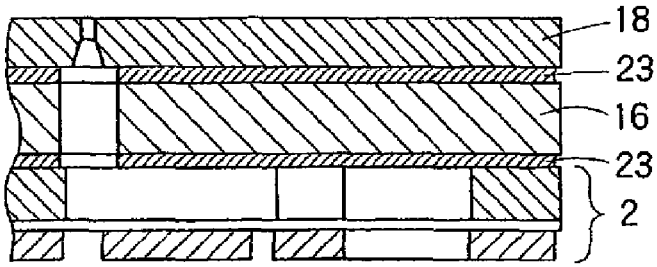
FIG. 7 is a fragmentary sectional view of a plate-shaped member, a base plate and a nozzle plate employed in a second modification of the ink-jet recording head shown in FIG. 1.

In a first modification of the ink-jet recording head in the first embodiment, the base member 16 may be omitted and the nozzle plate 18 may be bonded directly to the front surface 2*a* of the plate-shaped member 2 as shown in FIG. 6.

In a second modification of the ink-jet recording head in the first embodiment, polyolefin adhesive films 23 may be used for bonding together the base member 16 and the plate-shaped member 2 and bonding together the base member 16 and the nozzle plate 18.

An ink-jet recording head in a second embodiment according to the present invention will be described hereinafter with reference to FIG. 8. The ink-jet recording head in the second embodiment is a modification of the ink-jet recording head in the first embodiment and hence parts like or corresponding to those of the ink-jet recording head in the first embodiment are denoted by the same reference characters and the description thereof will be omitted. Only particulars specific to the second embodiment will be described.

Figure 8:
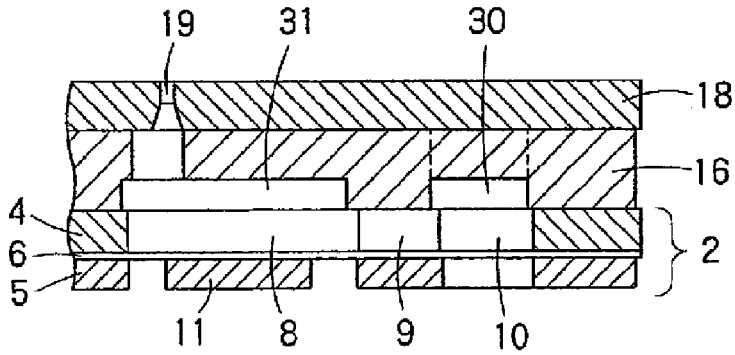
FIG. 8 is a fragmentary sectional view of an ink-jet recording head in a second embodiment according to the present invention.

As shown in FIG. 8, the base member 16 is provided with auxiliary ink storage chamber 30 connected to the common ink storage chamber 10, and auxiliary pressure chambers 31 respectively connected to the pressure chambers 8. The auxiliary ink storage chamber 30 is offset from the position corresponding to the common ink storage chamber 10 and partly overlaps the ink inlet passages 9. The auxiliary pressure chambers 31 are offset from the positions corresponding to the pressure chambers 8.

The auxiliary ink chamber 30 and the auxiliary pressure chambers 31 are effective in forming a common ink storage chamber having a sufficient volume and pressure chambers each having a sufficient volume when the first layer 4 cannot be formed in a thickness sufficient for forming the common ink storage chamber 10 and the pressure chambers 8 respectively having sufficient volumes. Although the depth of the auxiliary pressure chambers 31 is about half the thickness of the base member 16, the auxiliary pressure chambers 31 may be formed in a depth equal to the thickness of the base member 16 as indicated by broken lines in FIG. 8.

Since the auxiliary ink storage chamber 30 is offset from the position corresponding to the common ink storage chamber 10, crosstalk between the adjacent pressure chambers 8 can be prevented, and bubbles can be easily transferred from the common ink storage chamber 10 to the pressure chambers 8 and can be readily discharged through the nozzle holes 19.

An ink-jet recording head in a third embodiment according to the present invention will be described with reference to FIG. 9. The ink-jet recording head in the third embodiment is a modification of the ink-jet recording head in the foregoing embodiments and hence parts like or corresponding to those of the foregoing embodiments are denoted by the same reference characters and the description thereof will be omitted. Only particulars specific to the ink-jet recording head in the third embodiment will be described.

Figure 9:
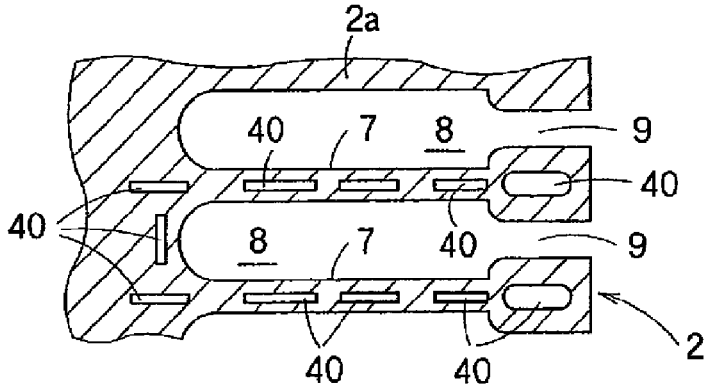
FIG. 9 is a sectional view of partition walls of a plate-shaped member included in an ink-jet recording head in a third embodiment according to the present invention.

As shown in FIG. 9, a plurality of adhesive receiving grooves 40 are formed in portions of the front surface 2*a* of the plate-shaped member 2 corresponding to the partition walls 7. When bonding the nozzle plate 8 or the base member 16 to the front surface 2*a* of the plate-shaped member 2 with an adhesive, excessive part of the adhesive is forced into the adhesive receiving grooves 40, so that the adhesive does not protrude into the pressure chambers 8 and the ink inlet passages 9.

Since the protrusion of the adhesive into the pressure chambers 8 and the ink inlet passages 9 can be suppressed, the performance deterioration of the ink-jet recording head due to the protrusion of the adhesive into the pressure chambers 8 and the ink inlet passages 9 can be prevented.

An ink-jet recording head in a fourth embodiment according to the present invention will be described with reference to FIG. 10. The ink-jet recording head in the fourth embodiment is a modification of the ink-jet recording head in the foregoing embodiments and hence parts like or corresponding to those of the foregoing embodiments are denoted by the same reference characters and the description thereof will be omitted. Only particulars specific to the ink-jet recording head in the fourth embodiment will be described.

Figure 10:
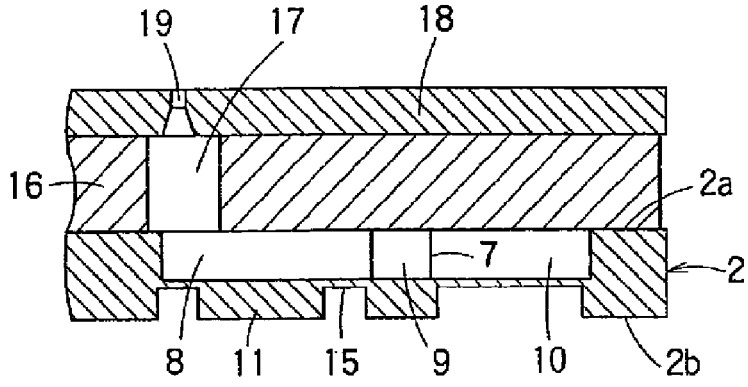
FIG. 10 is a fragmentary, sectional view of a plate-shaped member, a base plate and a nozzle plate included in an ink-jet recording head in a fourth embodiment according to the present invention.

Referring to FIG. 10, the plate-shaped member 2 is formed by etching a single sheet which is made of a single material, such as a stainless steel sheet. The front surface 2*a* of the plate-shaped member 2, i.e., a stainless steel sheet, is etched in a depth equal to part of the thickness of the plate-shaped member 2 by the first etching process described above-referring to FIG. 1 to form the partition walls 7. Preferably, the first etching process is a dry etching process capable of accurately controlling etch depth.

The back surface 2*b* of the plate-shaped member 2 is etched in a depth equal to part of the thickness of the plate-shaped member 2 by the second etching process described above referring to FIG. 1 to form the plurality of lands 11. Preferably, the second etching process is a dry etching process capable of accurately controlling etch depth.

After the first and the second etching processes are completed, the elastically deformable parts remain around the lands 11 in the plate-shaped member 2. In other words, the elastically deformable parts are formed by reducing the thickness of the plate-shaped member 2 from both sides thereof around the lands 11.

According to the present embodiment, the numbers of necessary parts and necessary steps for producing the plate-shaped member 2 can be reduced because the plate-shaped member 2 is made of a single sheet which is made of a single material.

Figure 11A:
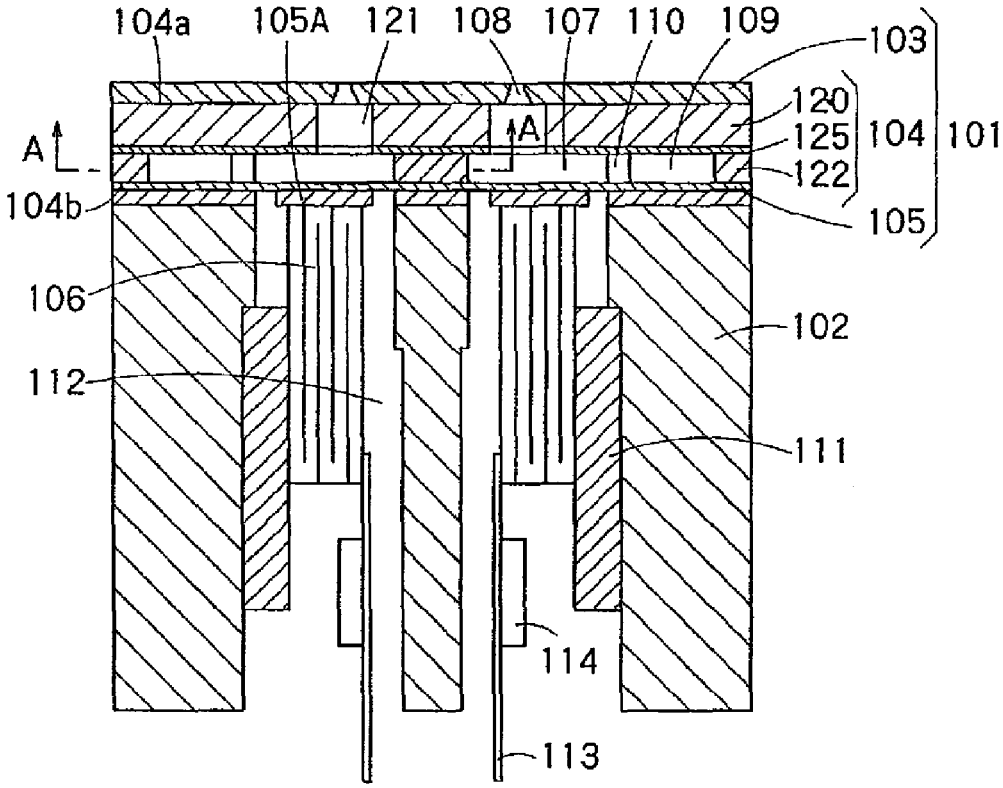
FIG. 11A is a longitudinal sectional view of an ink-jet recording head in a fifth embodiment according to the present invention.
Figure 11B:
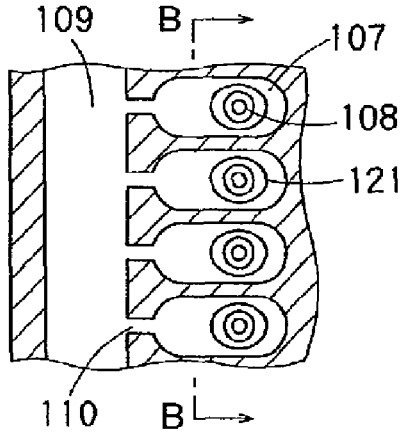
FIG. 11B is a sectional view taken on line A-A in FIG. 11A.
Figure 11C:
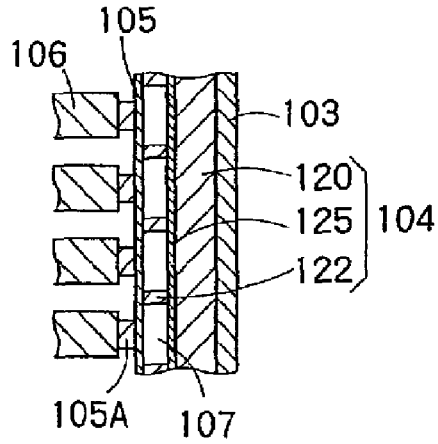
FIG. 11C is a sectional view taken on line B-B in FIG. 11B.

An ink-jet recording head in a fifth embodiment according to the present invention will be described with reference to FIGS. 11A, 11B and 11C. The ink-jet recording head in the fifth embodiment employs piezoelectric vibrators 106 of a longitudinal vibration mode. As shown in FIGS. 11A, 11B and 11C, the inkjet recording head has a passage unit 101 provided with nozzle holes 108 and pressure chambers 107, and a case 102 containing the piezoelectric vibrators 106. The passage unit 101 is attached to the case 102.

The passage unit 101 is formed by superposing and bonding together a nozzle plate 103 of a stainless steel provided with the nozzle holes 108, a passage plate 104 provided with pressure chambers 107 connected to the nozzle holes 108, and a vibrating plate 105 covering the open back ends of the pressure chambers 107. The passage plate 104 has a front surface 104*a* and a back surface 104*b*.

The passage plate 104 is formed by superposing a first base plate 120 provided with connecting holes 121 connected to the nozzle holes 108, an etch terminating layer 125 and a second base plate 122. The etch terminating layer 125 is formed on the back surface of the first base plate 120, and the second base plate 122 is attached to the etch terminating layer 125.

There are not any particular restrictions on the material for forming the first base plate 120, provided that the material is properly rigid and is capable of being etched. Suitable materials for forming the first base plate 120 include stainless steels, nickel, aluminum, iron, copper and zinc. Stainless steels and nickel are preferable materials because these metals are excellent in corrosion resistance and can be comparatively easily etched.

There are not any particular restrictions on the material for forming the second base plate 122, provided that the material is properly rigid and is capable of being etched. Suitable materials for forming the second base plate 122 include stainless steels, nickel, aluminum, iron, copper and zinc. Stainless steels and nickel are preferable materials because these metals are excellent in corrosion resistance and can be comparatively easily etched.

There are not any particular restrictions on the material for forming the etch terminating layer 125 provided that etch terminating layer 125 is unsusceptible to etching actions exerted thereon by the etching processes to which a laminated structure formed by bonding together the first base plate 120, the etch terminating layer 125 and the second base plate 122 is subjected to etch the first base plate 120 and the second base plate 122. Suitable materials for forming the etch terminating layer 125 include thermosetting adhesives, such as epoxy adhesives, urethane adhesives and polyester adhesives, and thermoplastic adhesives, such as polyimide adhesives. These adhesives contain a volatile component in a small concentration and do not become porous after the volatile component has been volatilized. The etch terminating layer 125 may be made of a metal that is harder to be etched than the materials forming the first base plate 120 and the second base plate 122. The etch terminating layer 125 may be made of titanium, gold, silver or the like.

The first base plate 120 is etched through from its upper surface as viewed in FIG. 11A, i.e., the front surface 104*a* of the passage plate 104, such that portions of the etch terminating layer 125 are exposed in a predetermined pattern to form the connecting holes 121 to be connected to the nozzle holes 108.

The second base plate 122 is etched through from its lower surface as viewed in FIG. 11A, i.e., the back surface of the passage plate 104, such that portions of the etch terminating layer 125 are exposed in a predetermined pattern to form the pressure chambers 107, the ink inlet passages 110 connected to the pressure chambers 107 and ink storage chambers 109 for storing the ink to be supplied to the pressure chambers 107.

The case 102 is formed of a synthetic resin and has spaces 112 extending between the upper and the lower surface thereof. The piezoelectric vibrators 106 are contained in the spaces 112. The piezoelectric vibrators 106 have back ends fixed to base plates 111 attached to the case 102 and front ends fixed to lands 105A formed on the vibrating plate 105.

A driving signal produced by a driving circuit 114 is transmitted through a flexible wiring plate 113 to the corresponding piezoelectric vibrator 106 to vibrate the piezoelectric vibrator 106 longitudinally. Consequently, the land 105A of the vibrating plate 105 is vibrated to change the pressure in the pressure chamber 107, and thereby the ink contained in the pressure chamber 107 is jetted in an ink particle through the nozzle hole 108.

Thus, the connecting holes 121 are formed by etching the first base plate 120 such that portions of the etch terminating layer 125 are exposed, and the pressure chambers 107, the ink inlet passages 110 and the ink storage chambers 109 are formed by etching second base plate 122 such that portions of the etch terminating layer 125 are exposed. Therefore, the depth of the connecting holes 121 is equal to the thickness of the first base plate, and the depths of the pressure chambers 107, the ink inlet passages 110 and the ink storage chambers 109 are equal to the thickness of the second base plate 122 and hence the connecting holes 121, the pressure chambers 107, the ink inlet passages 110 and the ink storage chambers 109 can be highly accurately formed in desired depths, respectively. Partition walls defining the pressure chambers 107 are highly rigid and hence the pressure chambers 107 can be arranged in a high density. Since the ink-jet recording head does not have any components formed by electroforming on patterns and removed from the patterns, the accuracy of the ink-jet recording head is not reduced and the ink-jet recording head is advantageous in cost. The pressure chambers 107 and the connecting holes 121 can be accurately aligned with each other.

When the etch terminating layer 125 is a layer of a metal that is harder to be etched than the metals forming the first base plate 120 and the second base plate 122, which are subjected to the etching processes, or when the first base plate 120 and the second base plate 122 are formed of a stainless steel or nickel, and the etch terminating layer 125 is formed of titanium, silver or gold, the etching of the first base plate 120 and the second base plate 122 can be surely terminated and etching can be properly ended. Furthermore, the passage unit 101 does not warp greatly and can be formed in a large size because the component members of the passage unit 101 have substantially equal linear expansion coefficients.

Figure 12A:
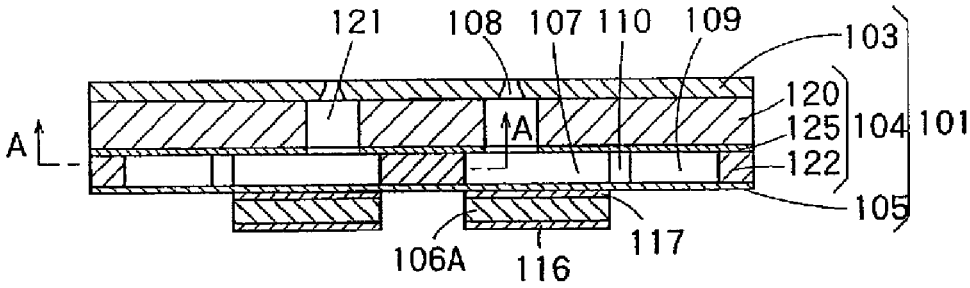
FIG. 12A is a longitudinal sectional view of a passage unit included in an ink-jet recording head in a sixth embodiment according to the present invention.
Figure 12B:
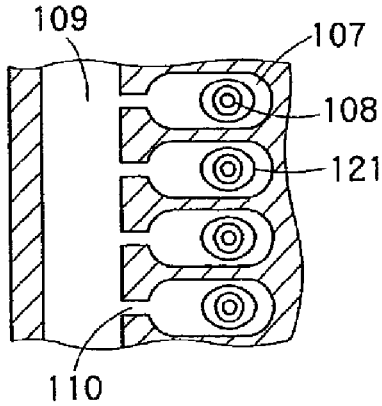
FIG. 12B is a sectional view taken on line A-A in FIG. 12A.

A passage unit included in an ink-jet recording head in a sixth embodiment according to the present invention will be described with reference to FIGS. 12A and 12B, in which parts like or corresponding to those of the ink-jet recording head shown in FIGS. 11A, 11B and 11C are denoted by the same reference characters and the description thereof will be omitted. This ink-jet recording head employs piezoelectric vibrators 106A of a flexural vibration mode. A vibrating unit formed by sandwiching the piezoelectric vibrator 106A between an upper electrode 116 and a lower electrode 117 is attached to the vibrating plate 105 included in the passage unit 101.

The piezoelectric vibrators 106A are driven for flexural vibrations by driving signals to change the pressure in the pressure chambers 107 to jet ink particles through the nozzle holes 108. The ink-jet recording head in the sixth embodiment is the same in operation and effect as that in the fifth embodiment shown in FIGS. 11A, 11B and 11C.

Figure 13:
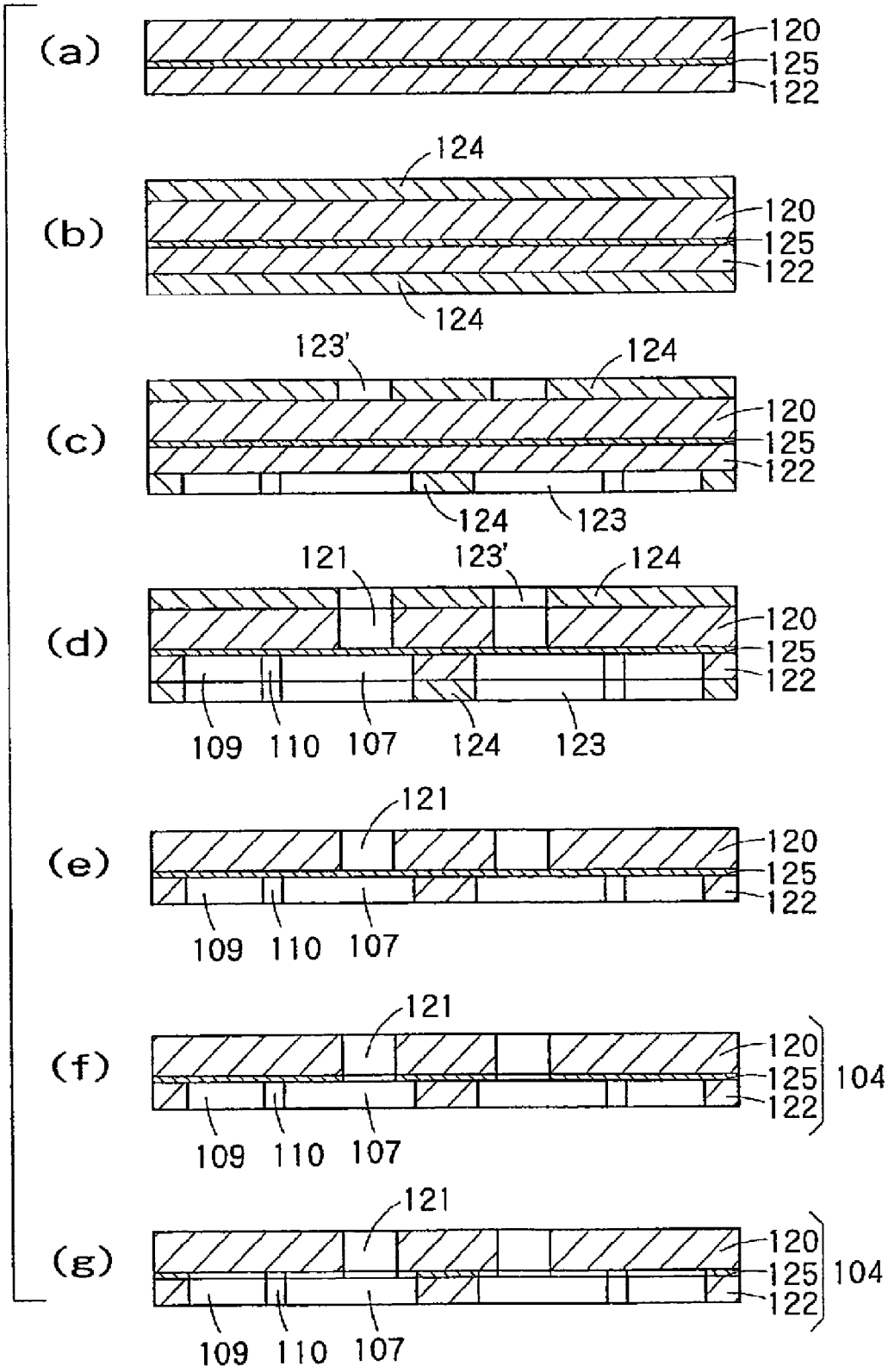
FIG. 13(*a*)-(*g*) show sectional views that help in explaining a method of manufacturing the ink-jet recording head provided with the passage unit shown in FIGS. 12A and 12B.

A method of manufacturing the ink-jet recording head provided with the passage unit 101 shown in FIGS. 12A and 12B will be described with reference to FIG. 13. As shown in FIG. 13, (a), the first base plate 120 and the second base plate 122 are bonded to the etch terminating layer 125 to form a laminated plate-shaped member. The etch terminating layer 125 is an adhesive film. For example, an adhesive is applied to one surface of either the first base plate 120 or the second base plate 122, and the first base plate 120 and the second base plate 122 are bonded together by the adhesive to form the laminated plate-shaped member.

As shown in FIG. 13, (b) and (c), the outer surfaces of the first base plate 120 and the second base plate 122 are coated with photosensitive resin films 124, respectively. The photosensitive resin films 124 are exposed to light in a connecting hole pattern 123' of the connecting holes 121 and a passage pattern 123 of the pressure chambers 107, the ink inlet passages 110 and the ink storage chambers 109, respectively. Then, the photosensitive resin films 124 are subjected to a developing process to form a mask having openings corresponding to the connecting holes 121 and a mask having openings corresponding to the pressure chambers 107, the ink inlet passages 110 and the ink storage chambers 109.

The photosensitive resin films 124 may be formed of any photosensitive resin, provided that the photosensitive resin is resistant to the corrosive effect of an etchant. A dry film photoresist is preferable because the dry film photoresist is capable of forming a comparatively thick film in a uniform thickness.

Subsequently, the laminated plate-shaped member is immersed in an etchant, the first base plate 120 and the second base plate 122 are connected to a positive electrode and a DC voltage is applied to the laminated plate-shaped member. Consequently, portions of the first base plate 120 corresponding to the openings in the connecting hole patter 123' and portions of the second base plate 122 corresponding to the openings in the passage pattern 123 are dissolved. As a result, the connecting holes 121 are formed in the first base plate 120 and the pressure chambers 107, the ink inlet passages 110 and the ink storage chambers 109 are formed in the second base plate 122 as shown in FIG. 13, (d). The etchant may be any suitable etchant, such as a ferric chloride solution.

Then, the photosensitive films 124 are removed as shown in FIG. 13, (e), and portions of the etch terminating layer 125 remaining in the connecting holes 121 are removed by blasting, pressing or laser machining as shown in FIG. 13, (f). When necessary, portions of the etch terminating layer 125 exposed in the pressure chambers 107, the ink inlet passages 110 and the ink storage chambers 109 are removed by blasting, laser machining or the like as shown in FIG. 13, (g). Removal of those portions of the etch terminating layer 125 is effective in preventing the adhesion of bubbles to those portions of the etch terminating layer 125 when the etch terminating layer 125 has a low ability to be wetted with the ink.

The recording head manufacturing method described with reference to FIG. 13 etches through the first base plate 120 and the second base plate 122 such that the desired portions of the etch terminating layer 125 are exposed to form the connecting holes 121, the pressure chambers 107, the ink inlet passages 110 and the ink storage chambers 109. Therefore, the depth of the connecting holes 121 is equal to the thickness of the first base plate 120 and the depths of the pressure chambers 107, the ink inlet passages 110 and the ink storage chambers 109 are equal to the thickness of the second base plate 122. Thus, those holes and chambers of the ink-jet recording head can be highly accurately formed. Partition walls defining the pressure chambers 107 are highly rigid and hence the pressure chambers 107 can be arranged in a high density. Since the ink-jet recording head does not have any components formed by electroforming on patterns and removed from the patterns, the accuracy of the ink-jet recording head is not reduced and the ink-jet recording head is advantageous in cost. The pressure chambers 107 and the connecting holes 121 can be accurately aligned with each other.

Figure 14:
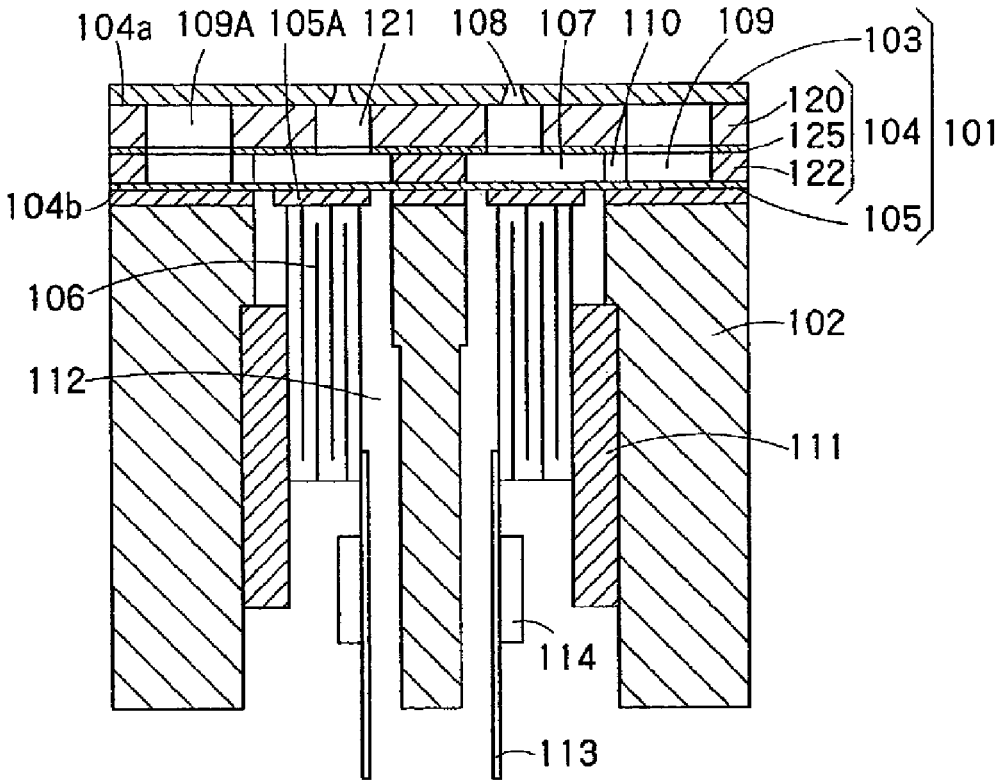
FIG. 14 is a longitudinal sectional view of an ink-jet recording head in a seventh embodiment according to the present invention.

FIG. 14 shows an ink-jet recording head in a seventh embodiment according to the present invention, which is similar to the ink-jet recording head shown in FIGS. 11A, 11B and 11C and hence parts like or corresponding to those of the ink-jet recording head shown in FIGS. 11A, 11B and 11C are denoted by the same reference characters and the description thereof will be omitted.

As shown in FIG. 14, the first base plate 120 is provided with the connecting holes 121 and auxiliary ink storage chambers 109A formed by etching. The auxiliary ink storage chambers 109A are additional ink storage chambers aligned with the ink storage chambers 109 formed in the second base plate 122.

Thus, the ink-jet recording head in the seventh embodiment is provided additionally with the auxiliary ink storage chambers 109A for the effective use of space. The ink storage chambers 109 and the auxiliary ink storage chambers 109A provide a sufficiently large ink storage volume, reduce passage resistance and suppress crosstalk. The ink-jet recording head in the seventh embodiment is the same in operation and effect as that in the fifth embodiment shown in FIGS. 11A, 11B and 11C.

A method of manufacturing the ink-jet recording head shown in FIG. 14 will be described with reference to FIG. 15.

Figure 15:
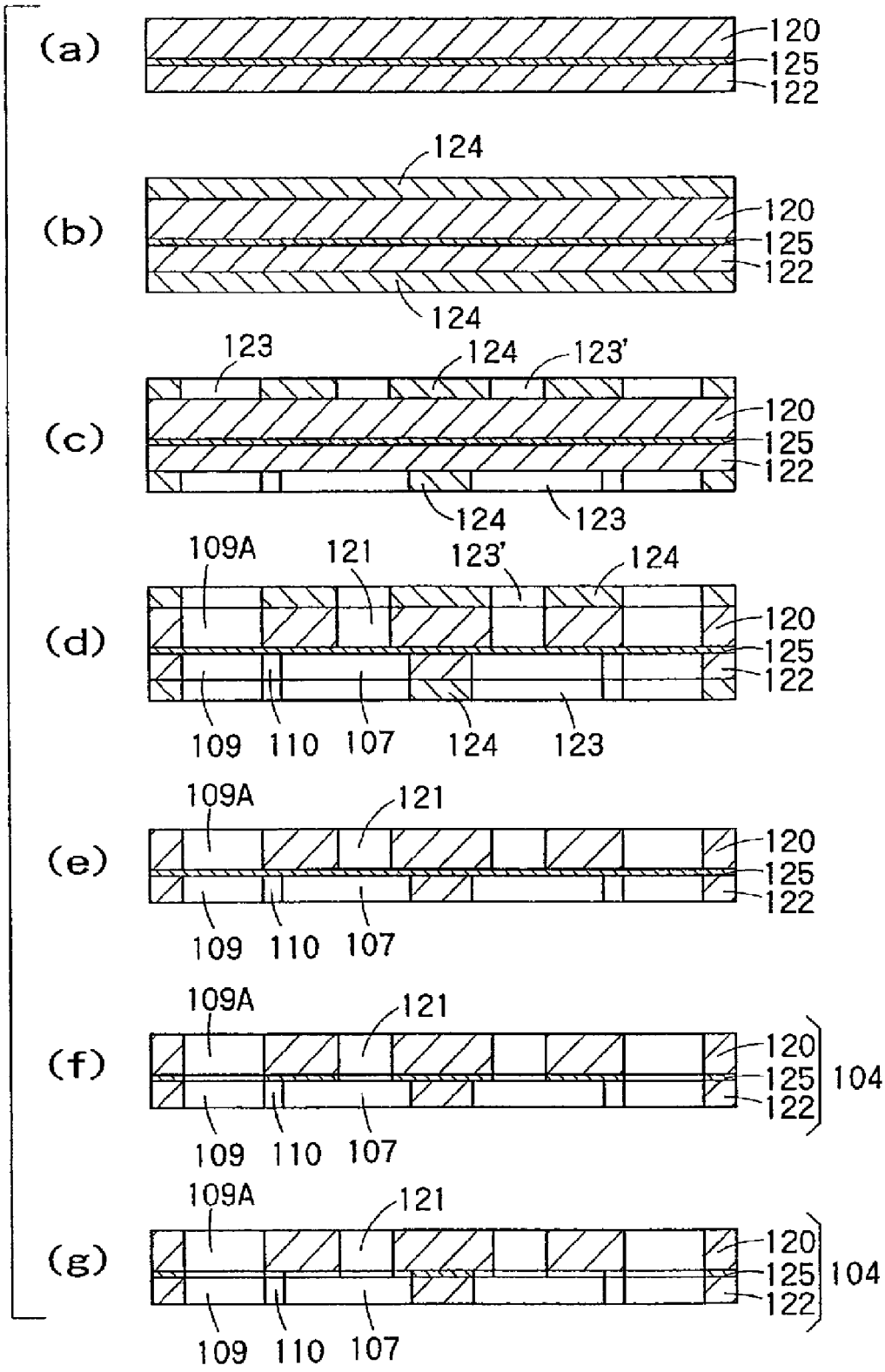
FIG. 15 is a sectional view of assistance in explaining a method of manufacturing the ink-jet recording head shown in FIG. 14.

As shown in FIG. 15, (a), the first base plate 120 and the second base plate 122 are bonded together by the etch terminating layer 125 to form a laminated plate-shaped member. As shown in FIG. 15, (b) and 15(*c*), the outer surfaces of the first base plate 120 and the second base plate 122 are coated with photosensitive resin films 124, respectively. The photosensitive resin films 124 are exposed to light in a connecting hole pattern 123' of the connecting holes 121 and a passage pattern 123 of the pressure chambers 107, the ink inlet passages 110 and the ink storage chambers 109, respectively. Then, the photosensitive resin films 124 are subjected to a developing process to form a mask having openings corresponding to the connecting holes 121 and a mask having openings corresponding to the pressure chambers 107, the ink inlet passages 110 and the ink storage chambers 109.

Subsequently, the laminated plate-shaped member is etched. Consequently, portions of the first base plate 120 corresponding to the openings in the connecting hole pattern 123' and portions of the second base plate 122 corresponding to the openings in the passage pattern 123 are dissolved. As a result, the connecting holes 121 and the auxiliary storage chambers 109A are formed in the first base plate 120 and the pressure chambers 107, the ink inlet passages 110 and the ink storage chambers 109 are formed in the second base plate 122 as shown in FIG. 15, (d).

Then, the photosensitive films 124 are removed as shown in FIG. 15, (e), and portions of the etch terminating layer 125 remaining in the connecting holes 121 and the auxiliary ink storage chambers 109A are removed by blasting, pressing or laser machining as shown in FIG. 15, (f) When necessary, portions of the etch terminating layer 125 exposed in the pressure chambers 107 and the ink inlet passages 110 are removed by blasting, laser machining or the like as shown in FIG. 15, (g).

The recording head manufacturing method described with reference to FIG. 15 is similar in steps to and the same in operation and effect as the recording head manufacturing method described with reference to FIG. 13, except that the former forms the auxiliary ink storage chambers 109A in addition to the connecting holes 121 in the first base plate 120.

Figure 16:
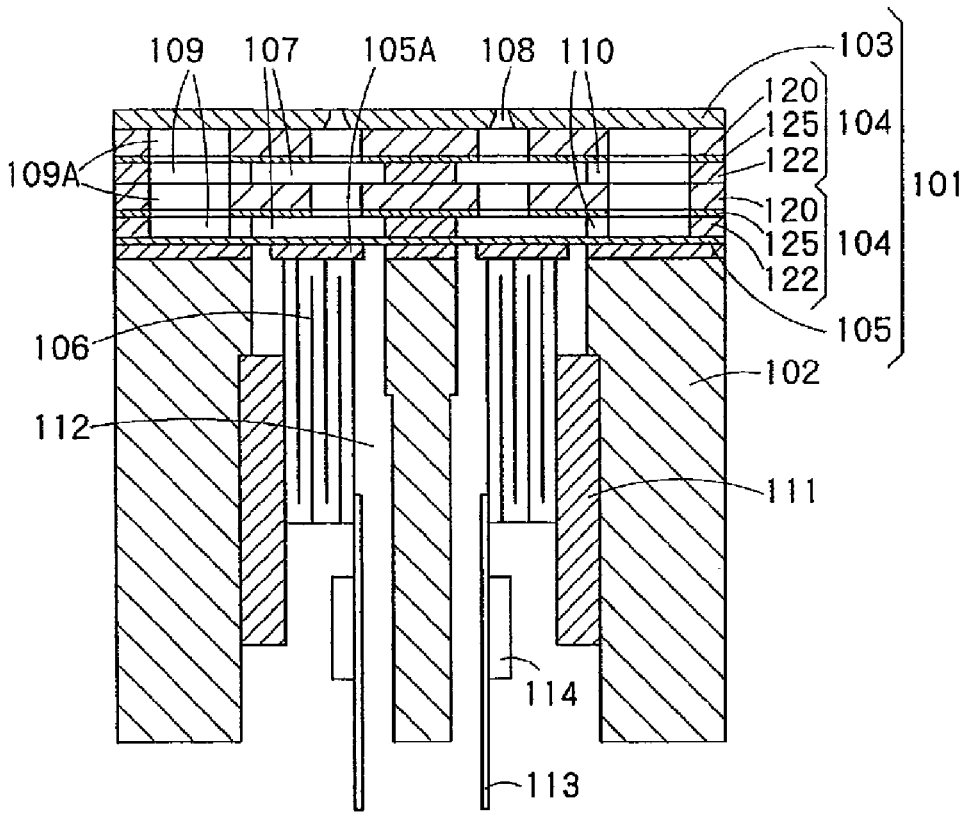
FIG. 16 is a longitudinal sectional view of an ink-jet recording head in an eighth embodiment according to the present invention.

FIG. 16 is a longitudinal sectional view of an ink-jet recording head in an eighth embodiment according to the present invention, which is similar to the ink-jet recording head in the seventh embodiment shown in FIG. 14 except that the former is provided with two passage plates 104, and hence parts like or corresponding to those of the ink-jet recording head in the seventh embodiment are denoted by the same reference characters and the description thereof will be omitted.

Each passage plate 104 is formed by sandwiching an etch terminating layer 125 between a first base plate 120 and a second base plate 122. The two passage plates 104 are superposed and bonded together with an epoxy adhesive, a two-sided adhesive tape or a polyolefin adhesive. Auxiliary ink storage chambers 109A are formed in portions of the first base plates 120 corresponding to the ink storage chambers 109 formed in the second base plates 122.

Since the ink-jet recording head in the eighth embodiment is provided with two second base plates 122, the pressure chambers 107 and the ink storage chambers 109 can be formed in sufficiently large volumes. Since the first base plates 120 are provided with the auxiliary ink storage chambers 109, i.e., additional ink storage chambers, space can be effectively used. Since the ink storage chambers 109 and the auxiliary ink storage chambers 109A have a sufficiently large ink storage capacity, passage resistance can be reduced and crosstalk across the ink storage chambers 109 can be suppressed. The ink-jet recording head in the eighth embodiment is the same in operation and effect as the ink-jet recording heads shown in FIGS. 11A, 11B, 11C and 14.

Figure 17:
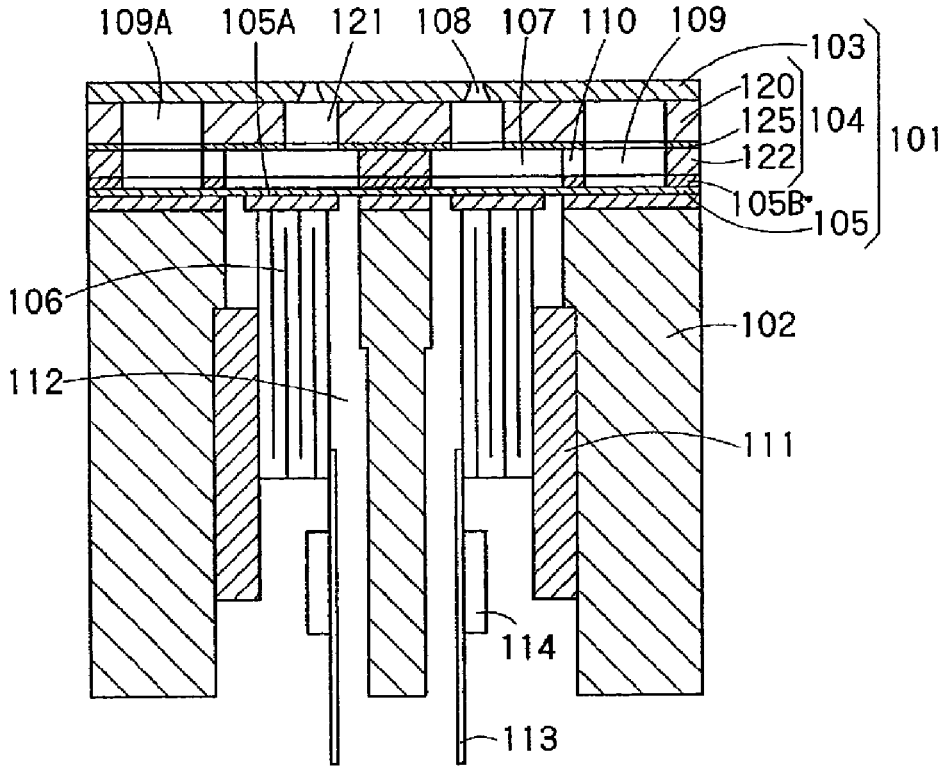
FIG. 17 is a longitudinal sectional view of an ink-jet recording head in a ninth embodiment according to the present invention.

FIG. 17 is a longitudinal sectional view of an ink-jet recording head in a ninth embodiment according to the present invention, which is similar to the ink-jet recording head in the seventh embodiment shown in FIG. 14 and hence parts like or corresponding to those of the ink-jet recording head in the seventh embodiment are denoted by the same reference characters and the description thereof will be omitted.

The ink-jet recording head in the ninth embodiment has a metal layer 105B formed on a surface of the vibrating plate 105 on the side of the pressure chambers 107. Portions of the metal layer 105B corresponding to the pressure chambers 107 and the ink storage chambers 109 are removed to form spaces respectively merging with the pressure chambers 107 and the ink storage chambers 109. The second base plate 122 is bonded to the metal layer 105B with an epoxy adhesive, a two-sided adhesive tape, a polyolefin adhesive or the like.

Since the spaces serving as part of the pressure chambers 107 and the ink storage chambers 109 formed in the second base plate 122 are formed in the metal layer 105B, space can be effectively used. Since the ink storage chambers 109 have a sufficiently large ink storage capacity, passage resistance can be reduced and crosstalk across the ink storage chambers 109 can be suppressed. The ink-jet recording head in the ninth embodiment is the same in operation and effect as the ink-jet recording heads shown in FIGS. 11A, 11B, 11C and 14.

Figure 18:
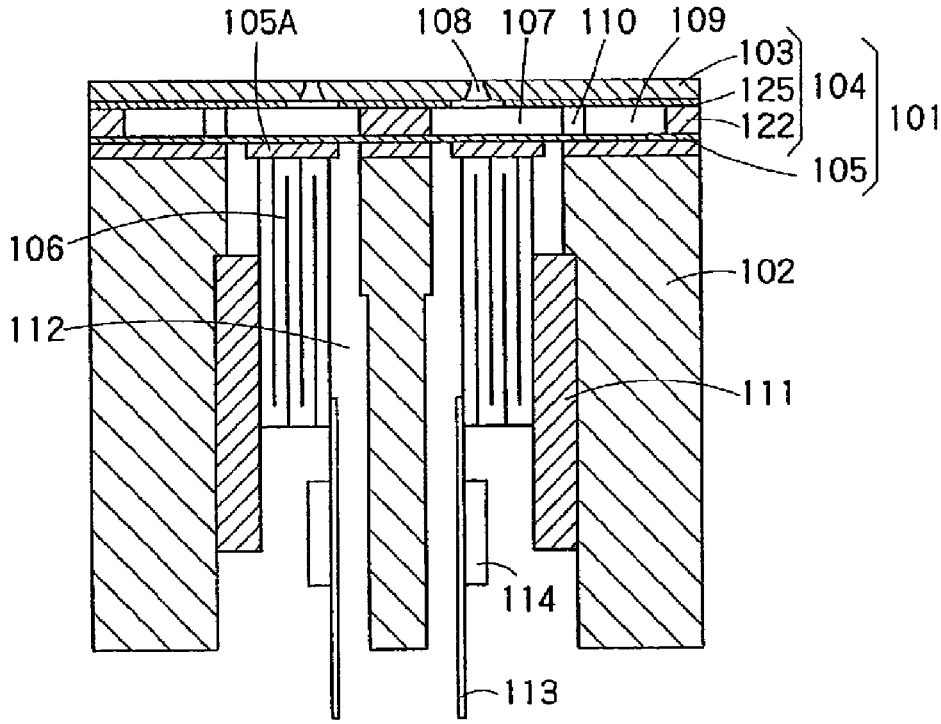
FIG. 18 is a longitudinal sectional view of an ink-jet recording head in a tenth embodiment according to the present invention.

FIG. 18 shows an ink-jet recording head in a tenth embodiment according to the present invention, which is similar to the ink-jet recording head in the fifth embodiment shown in FIGS. 11A, 11B and 11C and hence parts like or corresponding to those of the ink-jet recording head in the fifth embodiment are denoted by the same reference characters and the description thereof will be omitted.

As shown in FIG. 18, the ink-jet recording head is provided with the nozzle plate 103 having the nozzle holes 108 which serve also as the connecting holes 121 shown in FIG. 11A, and is not provided with any member corresponding to the first base plate 120 shown in FIG. 11A. The nozzle plate 103 serves also as the first base plate 120 of the ink-jet recording head shown in FIG. 11A. The passage unit 101 of this ink-jet recording head has less component members than those in the foregoing embodiments and is advantageous in the possibility of accuracy improvement and cost reduction.

The ink-jet recording heads in the foregoing embodiments employs the etch terminating layer 125 which is made of an adhesive. When an etch terminating layer of a metal, such as titanium, gold, silver or the like is employed, the nozzle plate 103 and the second base plate 122 may be bonded together by, for example, a cladding process. Although the present invention has been described as applied to the ink-jet recording heads that jet ink particles by vibrations generated by the piezoelectric vibrators, the present invention is applicable also to ink-jet recording heads of a bubble jet system for the same operation and effect.

In a modification, the passage plate 104 is formed by processing a single sheet which is made of a single material, such as a stainless steel sheet. The front surface 104*a* and the back surface 104*b* of the passage plate 104, i.e., a stainless steel sheet, may be etched in a depth equal to part of the thickness of the passage plate 104 by etching to form the connecting holes 121, the pressure chambers 107 and the ink storage chambers 109. Etch end point is determined on the basis of, for example, etching time.

An ink-jet recording head in an eleventh embodiment according to the present invention will be described with reference to FIGS. 19 to 23.

Figure 19:
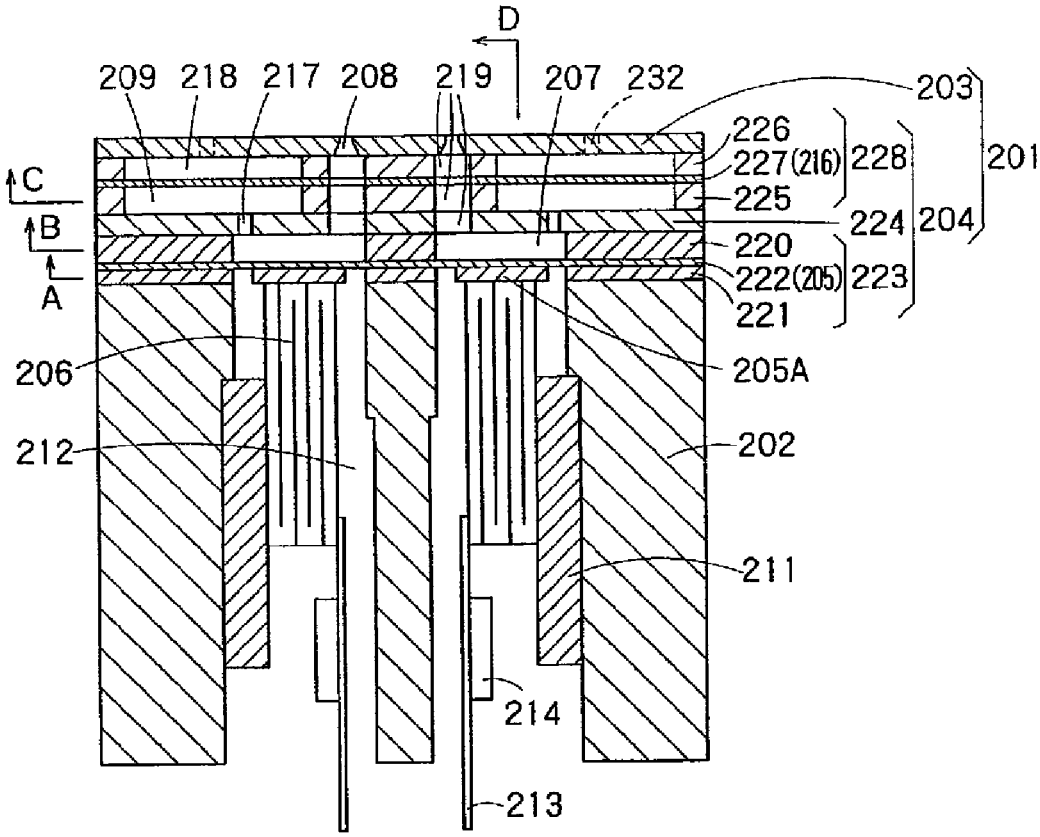
FIG. 19 is a longitudinal sectional view of an ink-jet recording head in an eleventh embodiment according to the present invention.

The ink-jet recording head shown in FIG. 19 employs piezoelectric vibrators 206 of a longitudinal vibration mode and has a passage unit 201 provided with nozzle holes 208 and pressure chambers 207, and a case 202 containing the piezoelectric vibrators 206. The passage unit 201 is attached to the case 202.

Figure 23:
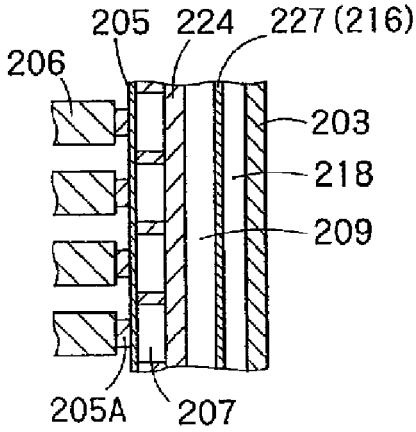
FIG. 23 is a fragmentary sectional view taken in a plane D in FIG. 19.

The passage unit 201 is formed by superposing and bonding together a nozzle plate 203 of a stainless steel provided with the nozzle holes 208, and a passage plate 204 provided with pressure chambers 207 connected to the nozzle holes 208, and ink storage chambers 209 for storing the ink to be supplied to the pressure chambers 207, and including a vibrating plate 205 covering the open back ends of the pressure chambers 207 as shown in FIG. 23.

Figure 21:
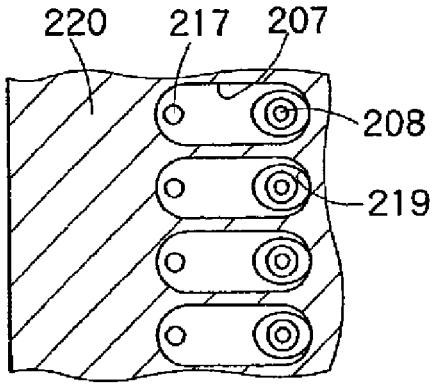
FIG. 21 is a fragmentary sectional view taken in a plane B in FIG. 19.

The passage plate 204 is formed by superposing a first base plate 223 provided with the pressure chambers 207, a second base plate 228 provided with connecting holes 219 respectively connecting the pressure chambers 207 to the nozzle holes 208, and the ink storage chambers 209, and an ink supply plate 224 sandwiched between the first base plate 223 and the second base plate 228. The ink supply plate 224 is provided with connecting holes 219 respectively connecting the pressure chambers 207 to the nozzle holes 208, and ink inlet passages 217 through which the ink is supplied from the ink storage chambers 209 into the pressure chambers 207. FIG. 21 shows the positional relation between the pressure chambers 207, the connecting holes 219, the nozzle holes 208 and the ink inlet passages 217.

Figure 20:
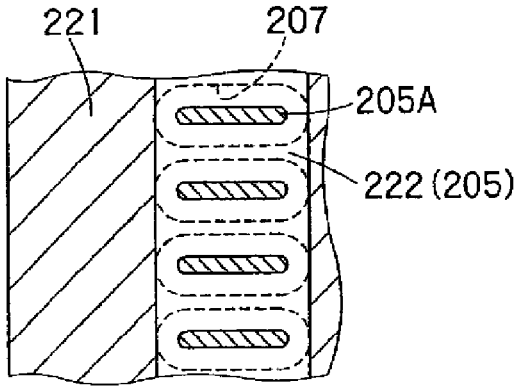
FIG. 20 is a fragmentary sectional view taken in a plane A in FIG. 19.

The first base plate 223 is formed by bonding together a first etching plate 220 provided with the pressure chambers 207 formed by etching, a first etch terminating layer 222 serving as a vibrating plate 205, and a second etching plate 221 having lands 205A formed on the back surface of the vibrating plate 205. FIG. 20 shows the positional relation between the pressure chambers 207 and the lands 205A.

Figure 22:
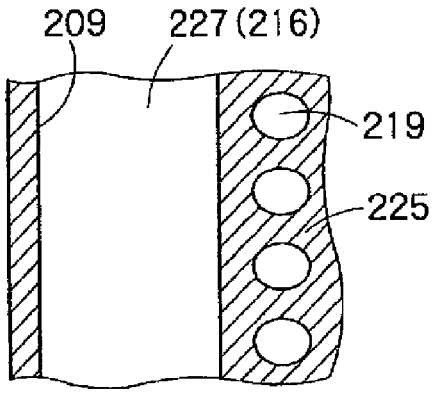
FIG. 22 is a fragmentary sectional view taken in a plane C in FIG. 19.

The second base plate 228 is formed by bonding together a third etching plate 225 provided with the ink storage chambers 209 by etching as shown in FIG. 22, a fourth etching plate 226 provided with damping chambers 218 by etching for absorbing pressure variation in the ink storage chambers 209, and a second etch terminating layer 227 sandwiched between the third etching plate 225 and the fourth etching plate 226 to serve as a damping flexible plate 216.

Since the ink-jet recording head has the passage plate 204 formed by sandwiching the ink supply plate 224 between the first base plate 223 and the second base plate 228, the ink storage chambers 209 are arranged on the side of the nozzle plate 203 with respect to the pressure chambers 207 so as to partly overlap the pressure chambers 207. The damping chambers 218 are arranged on the side of the nozzle plate 203 with respect to the ink storage chambers 209. In FIG. 19, indicated at 232 are vent holes formed in the nozzle plate 203 to open the damping chambers 218 into the atmosphere.

There are not any particular restrictions on materials forming the etching plates 220, 221, 225 and 226, provided that the materials are properly rigid and are capable of being etched. Materials suitable for forming the etching plates 220, 221, 225 and 226 include stainless steels, nickel, aluminum, iron, copper and zinc. Stainless steels and nickel are preferable because these metals are excellent in corrosion resistance and comparatively easy to etch.

There are not any particular restrictions on materials for forming the etch terminating layers 222 and 227 provided that the etching processes to the etching plates 220, 221, 225 and 226 are terminated by the first and the second etch terminating layers 222 and 227. Possible materials for forming the etch terminating layers 222 and 227 include thermosetting adhesives, such as epoxy adhesives, urethane adhesives, polyester adhesives and the like, and thermoplastic adhesives, such as polyimide adhesives and the like. These adhesives contain a volatile component in a small concentration and do not become porous after the volatile component has been volatilized. The etch terminating layers 222 and 227 may be films of a resin (polymer) or a metal that is harder to be etched than the material forming the etching plates 220, 221, 225 and 226. The etch terminating layers 222 and 227 may be made of titanium, gold, silver or the like.

A plate for forming the first etching plate 220 of the first base plate 223 is etched through such that portions of the first etch terminating layer 222 are exposed to form the pressure chambers 207. A plate for forming the second etching plate 221 is etched through such that portions of the first etch terminating layer 222 are exposed to form the lands 205A. The first etch terminating layer 222 that has not been etched serves as the vibrating plate 205.

A plate for forming the third etching plate 225 of the second base plate 228 is etched such that portions of the second etch terminating layer 227 are exposed to form the ink storage chambers 209, and a plate for forming the fourth etching plate 226 is etched such that portions of the second etch terminating layer 227 are exposed to form the damping chambers 218. The second etch terminating layer 227 which has not been etched serves as a damping film 216.

The case 202 is formed of a synthetic resin and has spaces 212 extending between the upper and the lower surface thereof. The piezoelectric vibrators 206 are contained in the spaces 212. The piezoelectric vibrators 206 of a longitudinal vibration mode have back ends fixed to base plates 211 attached to the case 202 and front ends fixed to lands 205A formed on the lower surface of the vibrating plate 205.

A driving signal produced by a driving circuit 214 is transmitted through a flexible wiring plate 213 to the corresponding piezoelectric vibrator 206 to vibrate the piezoelectric vibrator 106 longitudinally. Consequently, the land 205A of the vibrating plate 205 is vibrated vertically, as viewed in FIG. 19 to change the pressure in the pressure chamber 207, and thereby the ink contained in the pressure chamber 207 is jetted in an ink particle through the nozzle hole 208.

Since the ink storage chambers 209 are formed so as to overlap the pressure chambers 207, the passage unit 201 can be formed in an area far smaller than that of the passage unit of the conventional ink-jet recording head, so that the ink-jet recording head can be formed in very small dimensions and is advantageous to increasing the level of integration. Since the passage unit 201 can be formed in a comparatively great thickness, the longitudinal rigidity of the piezoelectric vibrators 206 of a longitudinal vibration mode can be greatly increased and crosstalk attributable to the deformation of the passage unit 201 can be suppressed. Since the damping chamber 218 is formed on the side of the nozzle plate 203 with respect to the pressure chamber 207, pressure variation in the ink storage chamber 209 can be absorbed to prevent crosstalk across the ink storage chamber 209 without entailing structural complication and enlargement.

The pressure chambers 207 and the lands 205A are formed by etching the first etching plate 220 and the second etching plate 221 such that portions of the first etch terminating layer 222 corresponding to the pressure chambers 207 and regions around the lands 205A are exposed. The ink storage chambers 209 and the damping chambers 218 are formed by etching the third etching plate 225 and the fourth etching plate 226 such that portions of the second etch terminating layer 227 corresponding of the ink storage chambers 209 and the damping chambers 218 are exposed. Therefore, the depths of the pressure chambers 207, the ink storage chambers 209, the damping chambers 218 and the thickness of the lands 205A are equal to the thickness of the first etching plate 220, the third etching plate 225, the fourth etching plate 226 and the second etching plate 221, respectively. Consequently, the pressure chambers 207, the ink storage chambers 209 and the damping chambers 218 can be formed highly accurately in desired depths and the lands 205A can be formed highly accurately in a desired thickness. Partition walls defining the pressure chambers 207 are highly rigid and hence the pressure chambers 207 can be arranged in a high density. Since the ink-jet recording head does not have any components formed by electroforming on patterns and removed from the patterns, the accuracy of the ink-jet recording head is not reduced and the ink-jet recording head is advantageous in cost.

The etch terminating layers 222 and 227 formed of an adhesive are capable of surely terminating etching and facilitate the fabrication of the passage plate 204.

When the etch terminating layers 222 and 227 are formed of metals harder to be etched than those forming the etching plates 220, 221, 225 and 226, or when the etching plates 220, 221, 225 and 226 are formed of a stainless steel or nickel and the etch terminating layers 222 and 227 are formed of titanium, silver or gold, the etching of the etching plate 220, 221, 225 and 226 can be surely terminated, the passage plate 204 does not warp greatly because the component members of the passage plate 204 have substantially equal linear expansion coefficients. The partition walls defining the pressure chambers 207 are highly rigid and hence the pressure chambers 207 can be arranged in a high density.

When the etch terminating layers 222 and 227 are resin films (films of polymeric materials) and the etch terminating layers 222 and 227 and the etching plates 220, 221, 225 and 226 are laminated with adhesive layers, the etching of the etching plates 220, 221, 225 and 226 can be surely terminated. Furthermore, the etch terminating layers 222 and 227 are highly strong and the etch terminating layers 222 and 227 are capable of properly functioning as the vibrating plate 205 and the damping film 216, respectively.

A method of manufacturing the ink-jet recording head in the eleventh embodiment shown in FIG. 19 will be explained.

Figure 24:
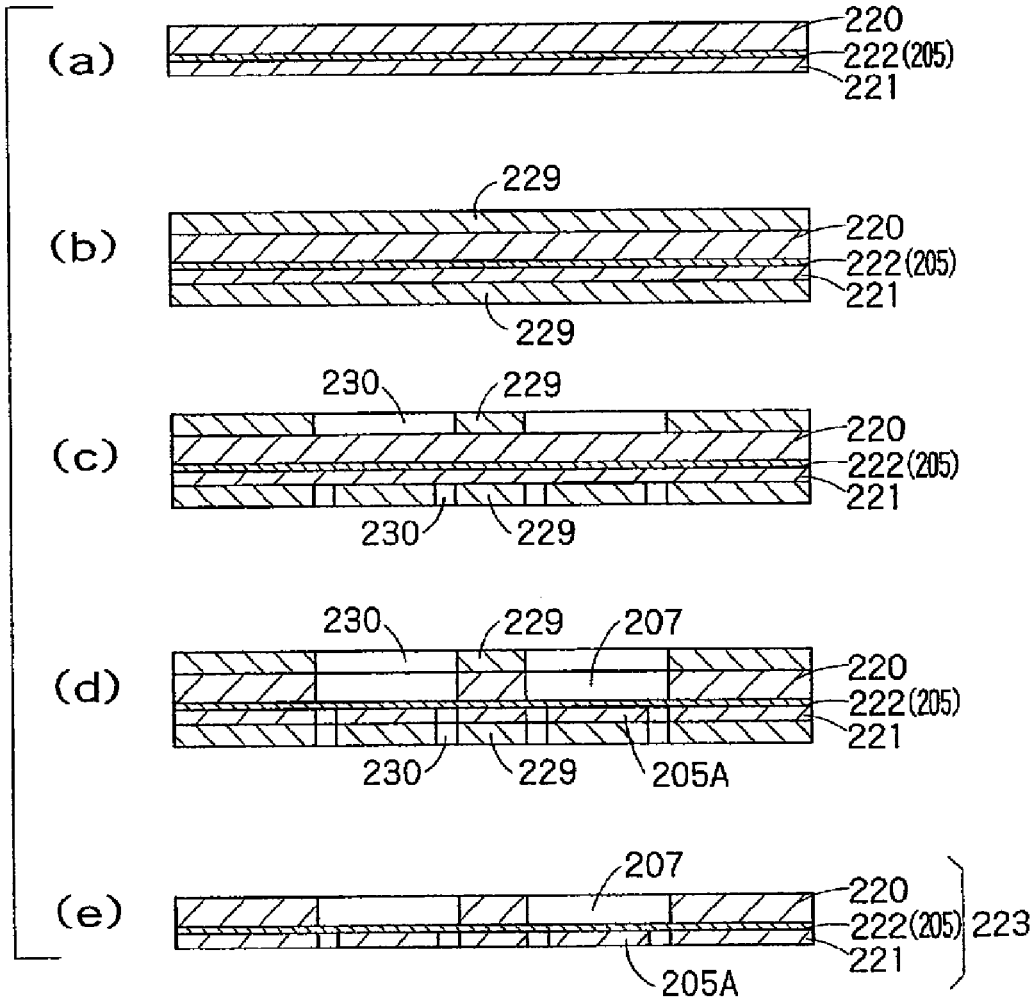
FIG. 24(*a*)-(*e*) show sectional views that help in manufacturing a first passage plate included in the ink-jet recording head shown in FIG. 19.
Figure 25:
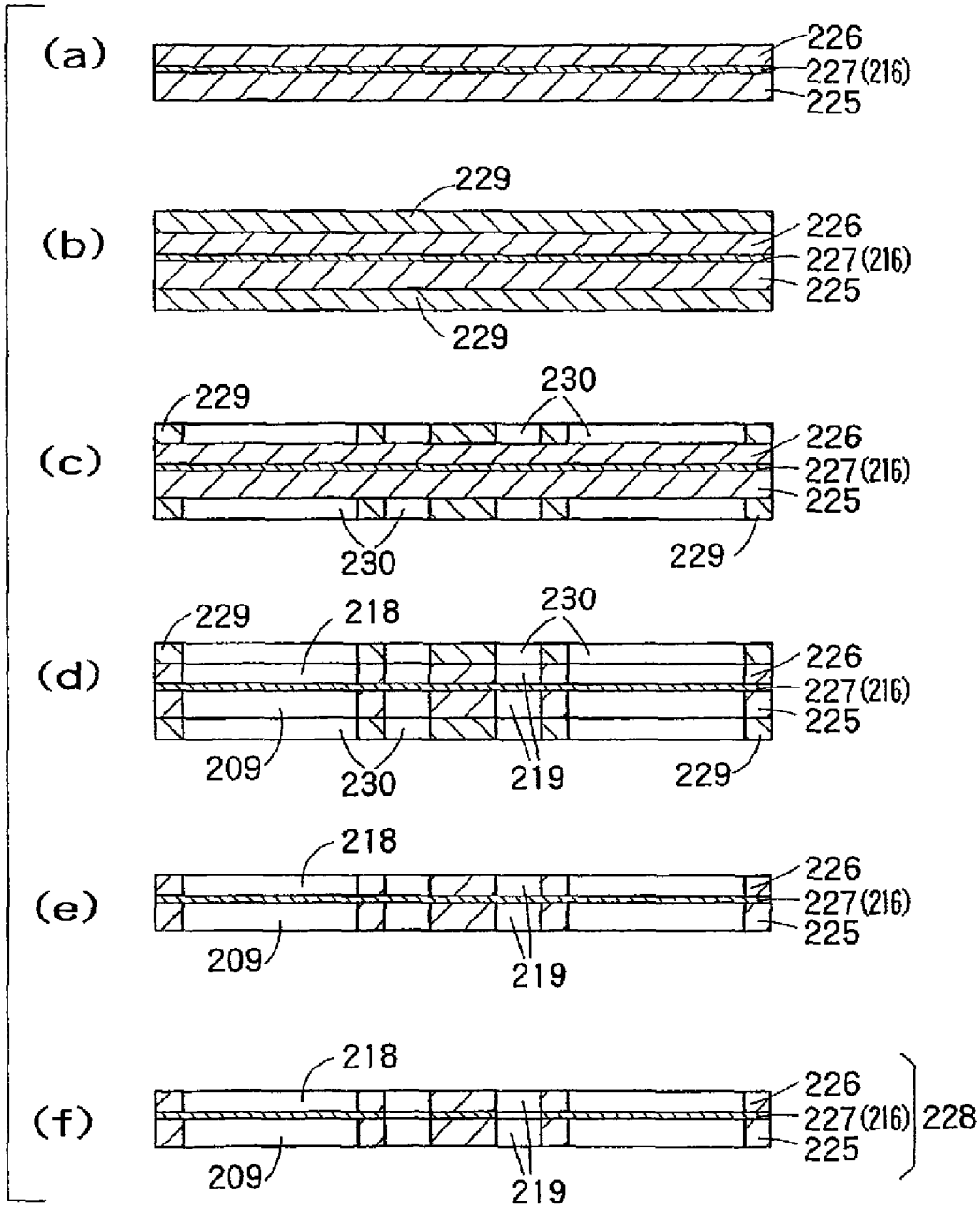
FIG. 25(*a*)-(*e*) show sectional views that help in explaining a method of manufacturing a second passage plate included in the ink-jet recording head shown in FIG. 19.
Figure 26:
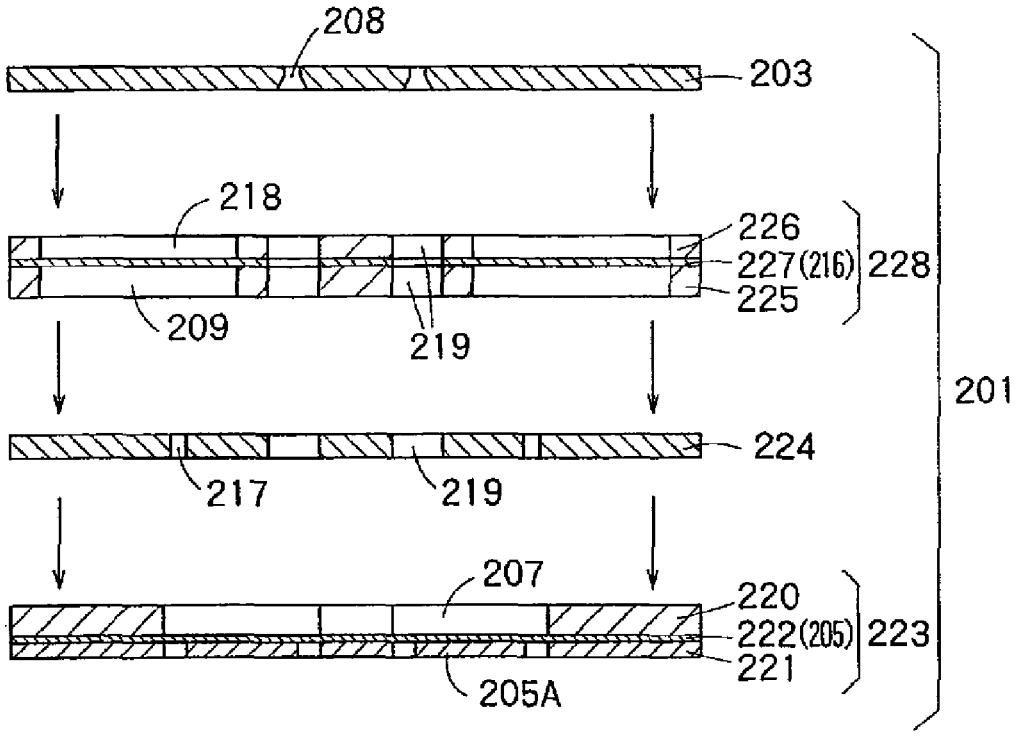
FIG. 26 is a sectional view of assistance in explaining a method of manufacturing a passage unit included in the ink-jet recording head shown in FIG. 19.

FIGS. 24, 25 and 26 illustrate processes for making the first base plate 223, the second base plate 228 and the passage unit 201, respectively.

Figure 27:
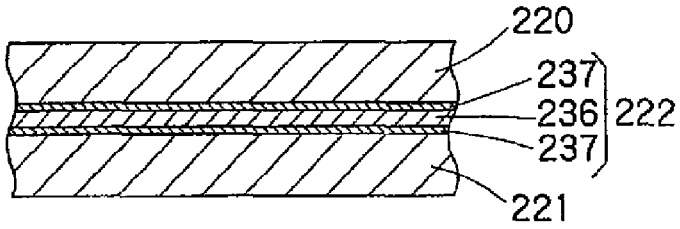
FIG. 27 is an enlarged, fragmentary sectional view of an etch terminating layer in the ink-jet recording head shown in FIG. 19.

The process for making the first base plate 223 will be described with reference to FIG. 24. The first etching plate 220, the second etching plate 221 and the first etch terminating layer 222 are laminated with the first etch terminating layer 222 sandwiched between the first etching plate 220 and the second etching plate 221 to form a laminated structure shown in FIG. 24, (a). The first etch terminating layer 222 is a resin film 236 having opposite surfaces coated with adhesive films 237 as shown in FIG. 27. The etching plates 220 and 221 are bonded to the opposite surfaces of the first etch terminating layer 222 by the adhesive films 237.

Then, as shown in FIG. 24, (b), photosensitive resin films 229 are formed on the exposed surfaces of the first etching plate 220 and the second etching plate 221. The photosensitive resin films 229 are exposed to light in patterns corresponding to the pressure chambers 207 and the regions around the lands 205A. The exposed photosensitive resin films 229 are subjected to a developing process to form masks having openings arranged in patterns corresponding to those of the pressure chambers 207 and the regions around the lands 205A, respectively, as shown in FIG. 24, (c).

The photosensitive resin films 229 may be formed of any photosensitive resin, provided that the photosensitive resin is resistant to the corrosive effect of an etchant. A dry film photoresist is preferable because the dry film photoresist is capable of forming a comparatively thick film in a uniform thickness.

The laminated structure provided with the masks is immersed in an etchant, the first etching plate 220 and the second etching plate 221 are connected to a positive electrode and a DC voltage is applied to the laminated structure. Portions of the etching plates 220 and 221 corresponding to the openings in the masks are etched to form the pressure chambers 207 and the lands 205A as shown in FIG. 24, (d). There is not any particular restriction on the etchant and any suitable etchant, such as a ferric chloride solution, may be used.

Then, as shown in FIG. 24, (e), the photosensitive resin films 229 forming the masks are removed to obtain the first base plate 223.

The process for making the second base plate 228 will be described with reference to FIG. 25. The third etching plate 225, the fourth etching plate 226 and the second etch terminating layer 227 are laminated with the second etch terminating layer 227 sandwiched between the third etching plate 225 and the fourth etching plate 226 to form a laminated structure shown in FIG. 25, (a). The second etch terminating layer 227, similarly to the first etch terminating layer 222 shown in FIG. 27, is a resin film 236 having opposite surfaces coated with adhesive films 237.

Then, as shown in FIG. 25, (b), photosensitive resin films 229 are formed on the exposed surfaces of the third etching plate 225 and the fourth etching plate 226. The photosensitive resin films 229 are exposed to light in patterns corresponding to patterns 230 of the ink storage chambers 209, the damping chambers 218 and the connecting holes 219. The exposed photosensitive resin films 229 are subjected to a developing process to form masks having openings arranged in patterns corresponding to the patterns 230 of the ink storage chambers 209, the damping chambers 218 and the connecting holes 219, respectively, as shown in FIG. 25, (c).

Portions of the third etching plate 225 and the fourth etching plate 226 corresponding to the openings of the patterns of the masks are etched to form the ink storage chambers 209, the damping chambers 218 and the connecting holes 219 as shown in FIG. 25, (d).

Then, as shown in FIG. 25, (e), the photosensitive resin films 229 forming the masks are removed and portions of the second etch terminating layer 227 remaining in the connecting holes 219 are removed by blasting, pressing or laser machining to obtain the second base plate 228 as shown in FIG. 25, (f).

The nozzle plate 203 with the nozzle holes 208 and the vent holes 232 is formed by subjecting a plate to pressing, laser machining or the like. The ink supply plate 224 provided with the connecting holes 219 and the ink inlet passages 217 is formed by subjecting a plate to pressing, laser machining or the like.

Then, as shown in FIG. 26, the nozzle plate 203, the second base plate 228, the ink supply plate 224 and the first base plate 223 are superposed in that order and are laminated with adhesives to complete the passage unit 201. The passage unit 201 is bonded to the case 202 containing the piezoelectric vibrators 206 to complete the ink-jet recording head shown in FIG. 13.

The method of manufacturing the ink-jet recording head according to the present invention forms the pressure chambers 207, the lands 205A, the ink storage chambers 209 and the damping chambers 218 by etching through the etching plates 220, 221, 225 and 226 such that portions of the etch terminating layers 222 and 227 corresponding to the pressure chambers 207, the regions around the lands 205A, the ink storage chambers 209 and the damping chambers 218 are exposed. Therefore, the depths of the pressure chambers 207, the ink storage chambers 209 and the damping chambers 218 and the thickness of the lands 205A are equal to the thicknesses of the corresponding etching plates 220, 221, 225 and 226, respectively. Consequently, the pressure chambers 207, the ink storage chambers 209 and the damping chambers 218 can be formed highly accurately in desired depths and the lands 205A can be formed highly accurately in a desired thickness. Partition walls defining the pressure chambers 207 are highly rigid and hence the pressure chambers 207 can be arranged in a high density. Since the ink-jet recording head does not have any components formed by electroforming on patterns and removed from the patterns, the accuracy of the ink-jet recording head is not reduced and the ink-jet recording head is advantageous in cost.

Figure 28:
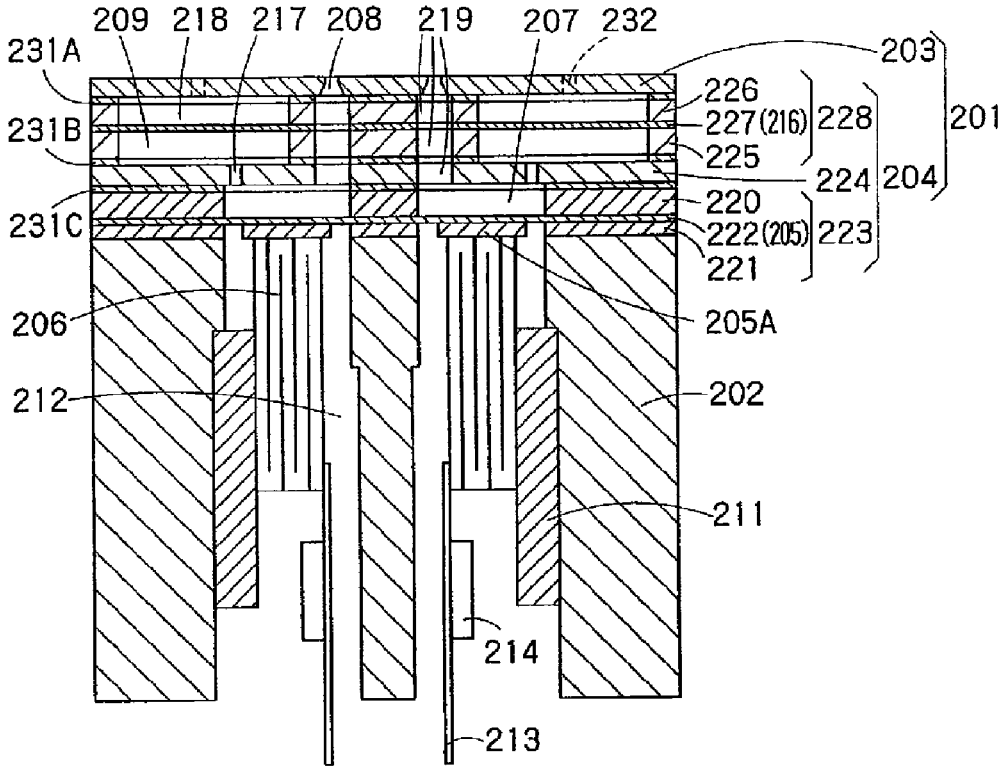
FIG. 28 is a longitudinal sectional view of an ink-jet recording head in a twelfth embodiment according to the present invention.

FIG. 28 shows an ink-jet recording head in a twelfth embodiment according to the present invention, which is similar to the ink-jet recording head in the eleventh embodiment shown in FIG. 19 except that the former has the nozzle plate 203, the second base plate 228, the ink supply plate 224 and the first base plate 223 superposed in that order and laminated by adhesive films 231A, 231B and 231C and hence parts like or corresponding to those of the ink-jet recording head in the eleventh embodiment shown in FIG. 19 are denoted by the same reference characters and the description thereof will be omitted. The ink-jet recording head in the twelfth embodiment is similar in operation and effect to the ink-jet recording head shown in FIG. 19.

Figure 29:
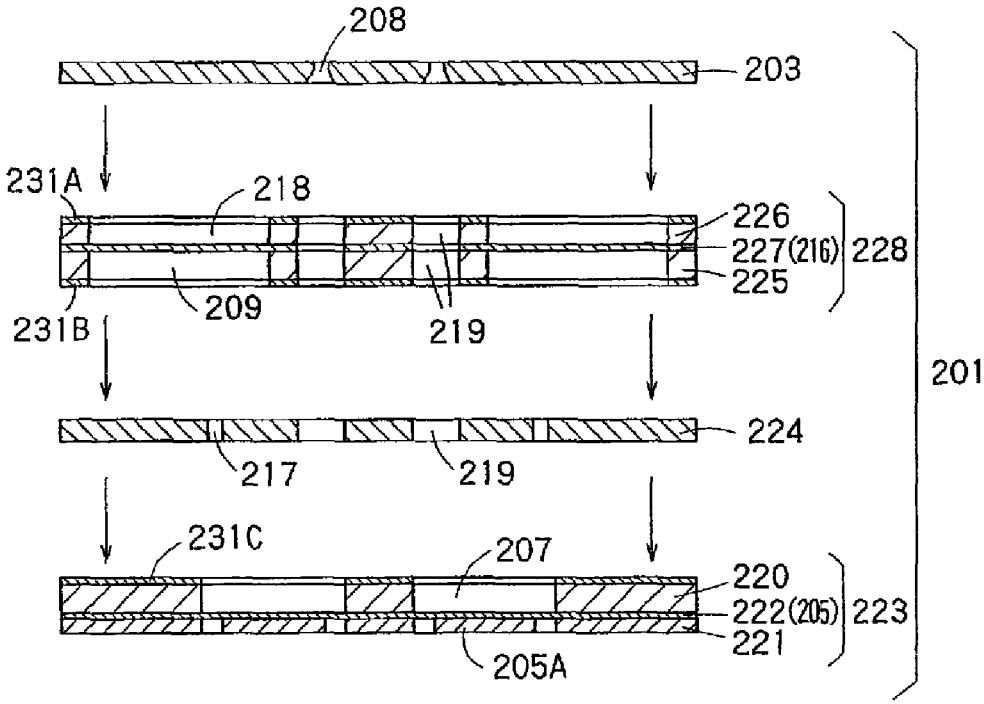
FIG. 29 is a sectional view of assistance in explaining a method of manufacturing the ink-jet recording heads shown in FIG. 28
Figure 30:
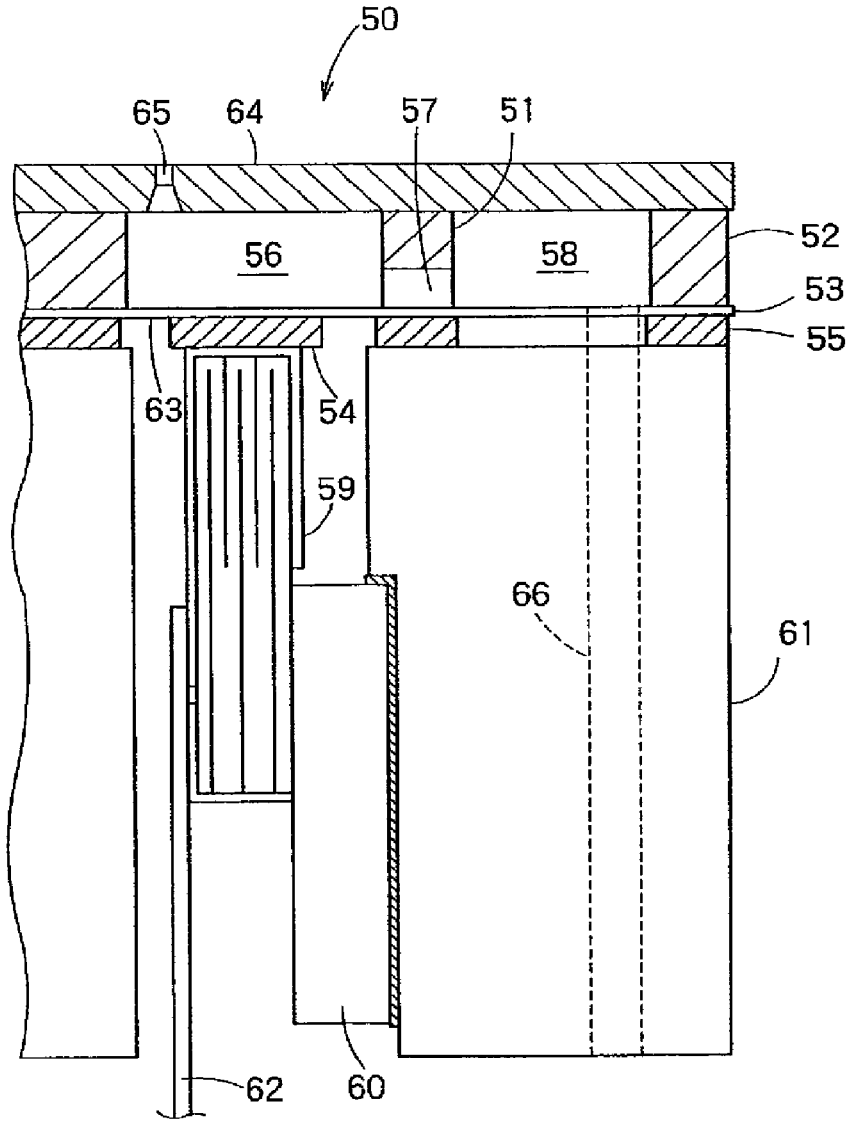
F I G. 30 PRIOR ART
FIG. 30 is a fragmentary sectional view of a known ink-jet recording head.
Figure 31:
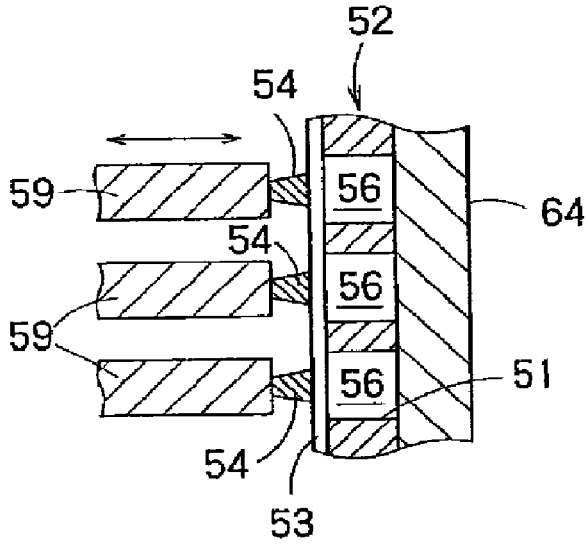
F I G. 31 PRIOR ART
FIG. 31 is an enlarged sectional view of pressure chambers and portions around them of the ink-jet recording head shown in FIG. 30.
Figure 32:
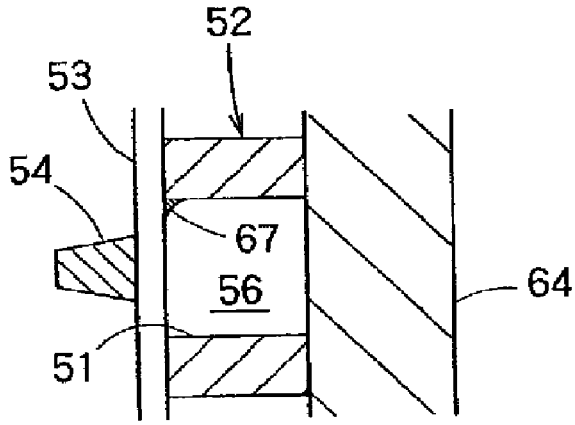
FIG. 32 is a sectional view of assistance in explaining a problem in the known ink-jet recording head.
Figure 33:
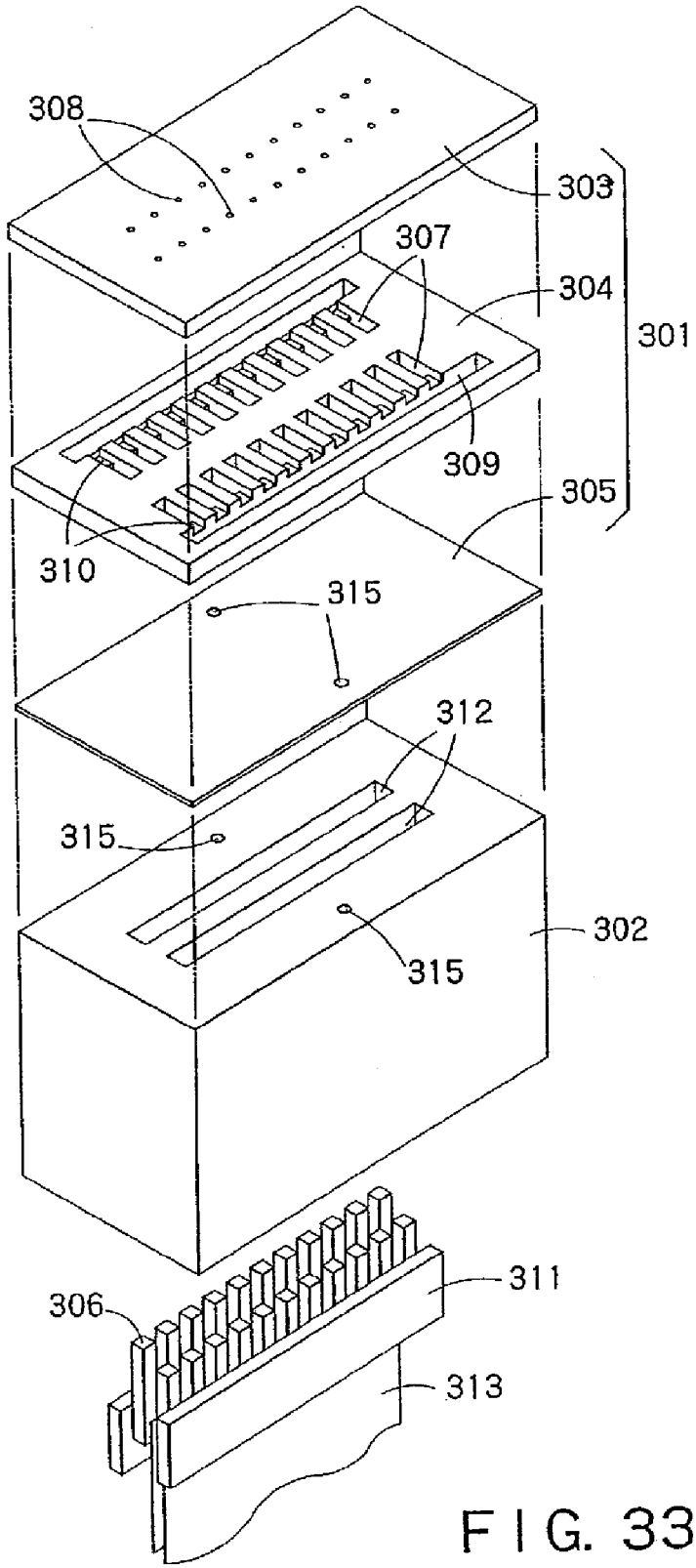
FIG. 33 PRIOR ART
FIG. 33 is an exploded perspective view of a known ink-jet recording head.
Figure 34:
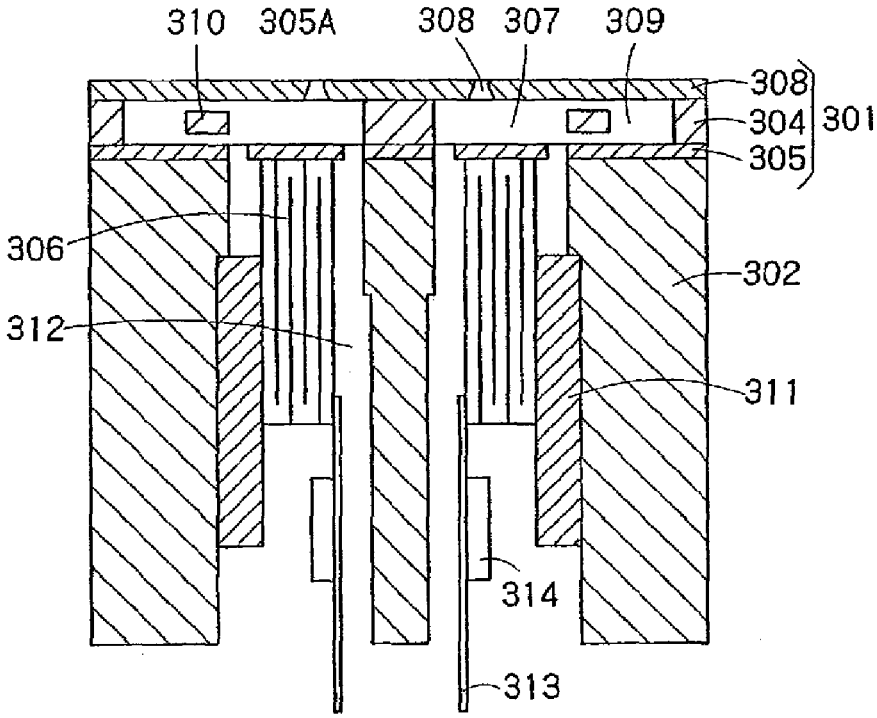
F I G. 34 PRIOR ART
FIG. 34 is a longitudinal sectional view of a known ink-jet recording head.

FIG. 29 is a view of assistance in explaining a method of manufacturing the ink-jet recording head shown in FIG. 28. In this method, the adhesive film 231C having openings corresponding to the pressure chambers 207 formed by punching is attached to the upper surface of the first base plate 223. The adhesive film 231A having openings corresponding to the damping chambers 218 formed by punching is attached to the upper surface of the second base plate 228. The adhesive film 231B having openings corresponding to the ink storage chambers 209 formed by punching is attached to the lower surface of the second base plate 228.

The first base plate 223 provided with the adhesive film 231C, the ink supply plate 224, the second base plate 228 provided with the adhesive films 231A and 231B, and the nozzle plate 203 are superposed in that order and bonded together to form the passage unit 201. Other steps of the method of manufacturing the ink-jet recording head shown in FIG. 28 are the same as those of the method previously described with reference to FIGS. 24 to 27.

The method illustrated in FIG. 29 prevents detrimental effects of adhesives protruding into spaces in which the ink is contained on ink jetting operations and failure in properly jetting ink particles due to bubbles that often form on adhesives protruded into spaces in which the ink is contained. The method is the same in operation and effect as the method illustrated in FIGS. 24 to 27.

Although each of the etch terminating layers 222 and 227 employed in the eleventh and the twelfth embodiment is the resin film 236 having opposite surfaces coated with the adhesive films 237, the etch terminating layers 222 and 227 may be bonded to the etching plates 220, 221, 225 and 226 by, for example, a cladding process when the etch terminating layers 222 and 227 are formed of a metal, such as titanium, gold, silver or the like. When the etch terminating layers 222 and 227 are layers of adhesives, adhesives may be applied in films to the etching plates 220, 221, 225 and 226 and the etching plates 220, 221, 225 and 226 may be bonded together for the same operation and effect.

What is claimed is:

1. An ink-jet recording head manufacturing method of manufacturing an ink-jet recording head comprising a pressure generating device for changing a pressure in a pressure chamber containing an ink; a plate-shaped member having a front surface and a back surface, the plate-shaped member having a partition wall formed on the front surface defining the pressure chamber, an ink supply passage and a common ink storage chamber, the plate-shaped member having a land formed on the back surface so as to correspond to the pressure chamber and be in contact with an extremity of the pressure generating device, the plate-shaped member having an elastic and deformable portion surrounding the land and being capable of being elastically deformed by a deformation of the pressure generating device; and a nozzle plate provided with a nozzle hole through which an ink droplet is ejected when the pressure in the pressure chambers is changed by the deformation of the pressure producing device, the nozzle plate being disposed on a side of the front surface of the plate-shaped member; the ink-jet recording head manufacturing method comprising:

a first etching step for etching the plate-shaped member to form the partition wall on the front surface of the plate-shaped member;

a second etching step for etching the plate-shaped member to form the land on the back surface of the plate-shaped member; and a nozzle plate attaching step for attaching the nozzle plate directly to or via another member to the front surface of the plate-shaped member;

wherein:

the plate-shaped member includes a first layer having the front surface, a second layer having the back surface and an intermediate layer sandwiched between the first and the second layers, the first etching step etches a desired portion of the first layer selectively over the intermediate layer so that the first layer is penetrated, the second etching step etches a desired portion of the second layer selectively over the intermediate layer so that the second layer is penetrated the plate-shaped member includes a first layer having the front surface, a second layer having the back surface, an intermediate layer sandwiched between the first and the second layers, a first adhesive layer bonding the first layer and the intermediate layer together and a second adhesive layer bonding the second layer and the intermediate layer together, the first etching step etches a desired portion of the first layer selectively over the first adhesive layer so that the first layer is penetrated, and the second etching step etches a desired portion of the second layer selectively over the second adhesive layer so that the second layer is penetrated.

2. An ink-jet recording head manufacturing method of manufacturing an ink-jet recording head comprising a pressure generating device for changing a pressure in a pressure chamber containing an ink; a plate-shaped member having a front surface and a back surface, the plate-shaped member having a partition wall formed on the front surface defining the pressure chamber, an ink supply passage and a common ink storage chamber, the plate-shaped member having a land formed on the back surface so as to correspond to the pressure chamber and be in contact with an extremity of the pressure generating device, the plate-shaped member having an elastic and deformable portion surrounding the land and being capable of being elastically deformed by a deformation of the pressure generating device; and a nozzle plate provided with a nozzle hole through which an ink droplet is ejected when the pressure in the pressure chambers is changed by the deformation of the pressure producing device, the nozzle plate being disposed on a side of the front surface of the plate-shaped member; the ink-jet recording head manufacturing method comprising:

a first etching step for etching the plate-shaped member to form the partition wall on the front surface of the plate-shaped member;

a second etching step for etching the plate-shaped member to form the land on the back surface of the plate-shaped member; and a nozzle plate attaching step for attaching the nozzle plate directly to or via another member to the front surface of the plate-shaped member;

wherein:

the plate-shaped member includes a first layer having the front surface, a second layer having the back surface and an intermediate layer sandwiched between the first and the second layers, the first etching step etches a desired portion of the first layer selectively over the intermediate layer so that the first layer is penetrated, the second etching step etches a desired portion of the second layer selectively over the intermediate layer so that the second layer is penetrated, the plate-shaped member is formed of a single sheet which is made of a single material, the first etching step etches a desired portion of the front surface of the plate-shaped member in a depth equal to part of a thickness of the plate-shaped member, and the second etching step etches a desired portion of the back surface of the plate-shaped member in a depth equal to part of the thickness of the plate-shaped member.

3. An ink-jet recording head manufacturing method of manufacturing an ink-jet recording head comprising a pressure generating device for changing a pressure in a pressure chamber containing an ink; a plate-shaped member having a front surface and a back surface, the plate-shaped member having a partition wall formed on the front surface defining the pressure chamber, an ink supply passage and a common ink storage chamber, the plate-shaped member having a land formed on the back surface so as to correspond to the pressure chamber and be in contact with an extremity of the pressure generating device, the plate-shaped member having an elastic and deformable portion surrounding the land and being capable of being elastically deformed by a deformation of the pressure generating device; and a nozzle plate provided with a nozzle hole through which an ink droplet is ejected when the pressure in the pressure chambers is changed by the deformation of the pressure producing device, the nozzle plate being disposed on a side of the front surface of the plate-shaped member; the ink-jet recording head manufacturing method comprising:

a first etching step for etching the plate-shaped member to form the partition wall on the front surface of the plate-shaped member;

a second etching step for etching the plate-shaped member to form the land on the back surface of the plate-shaped member; and a nozzle plate attaching step for attaching the nozzle plate directly to or via another member to the front surface of the plate-shaped member wherein:

the plate-shaped member includes a first layer having the front surface, a second layer having the back surface and an intermediate layer sandwiched between the first and the second layers, the first etching step etches a desired portion of the first layer selectively over the intermediate layer so that the first layer is penetrated, the second etching step etches a desired portion of the second layer selectively over the intermediate layer so that the second layer is penetrated, a base member is disposed between the plate-shaped member and the nozzle plate, and the plate-shaped member and the nozzle plate are bonded to the base member with polyolefin adhesive films.

* * * * *